US009320084B2

(12) United States Patent
Weiss et al.

(10) Patent No.: US 9,320,084 B2
(45) Date of Patent: Apr. 19, 2016

(54) HEATER WIRE SAFETY CIRCUIT

(71) Applicant: Weiss Controls, Inc., Holtsville, NY (US)

(72) Inventors: John W. Weiss, Oakdale, NY (US); Kuang-Pu Liao, Pingzhen (TW)

(73) Assignee: Weiss Controls, Inc., Holtsville, NY (US)

( * ) Notice: Subject to any disclaimer, the term of this patent is extended or adjusted under 35 U.S.C. 154(b) by 630 days.

(21) Appl. No.: 13/682,101

(22) Filed: Nov. 20, 2012

(65) Prior Publication Data

US 2013/0134149 A1 May 30, 2013

Related U.S. Application Data

(63) Continuation-in-part of application No. 13/306,030, filed on Nov. 29, 2011.

(60) Provisional application No. 61/516,802, filed on Apr. 8, 2011, provisional application No. 61/458,668, filed on Nov. 29, 2010.

(51) Int. Cl.

| | |
|---|---|
| ***H05B 1/02*** | (2006.01) |
| ***H05B 3/14*** | (2006.01) |
| ***H05B 3/56*** | (2006.01) |

(52) U.S. Cl.

CPC ..... *H05B 1/02* (2013.01); *H05B 3/146* (2013.01); *H05B 3/56* (2013.01); *H05B 2203/02* (2013.01)

(58) Field of Classification Search

CPC ..... H05B 1/02; H05B 3/146; H05B 3/12; H05B 3/56; H05B 2203/02

USPC ..... 219/212, 505, 501, 508, 481; 4/420.2

See application file for complete search history.

(56) References Cited

U.S. PATENT DOCUMENTS

| | | | | |
|---|---|---|---|---|
| 4,278,874 A | | 7/1981 | Cole | 219/505 |
| 4,532,414 A | * | 7/1985 | Shah | A61M 5/44 165/46 |

(Continued)

OTHER PUBLICATIONS

Notification of Transmittal of the International Search Report and the Written Opinion of the International Searching Authority, or the Declaration (in English) dated May 23, 2012, International Search Report (in English) dated May 23, 2012 and Written Opinion of the International Searching Authority (in English) dated May 23, 2012.

(Continued)

*Primary Examiner* — Mark Paschall

(74) *Attorney, Agent, or Firm* — Gerald T. Bodner

(57) ABSTRACT

A dual heater wire circuit for use with a heating pad or electric blanket includes two independent heater wire circuits. Each heater wire circuit includes a heater wire and a temperature sensor conductor. The temperature sensor conductor of each heater wire circuit is connected to a capacitor, or to a resistor, to define with the capacitor or resistor a voltage divider circuit. The juncture between the sensor conductors and either the capacitor or the resistor is provided to the input of a microprocessor. The electrical resistance of the temperature sensor conductors varies with temperature. The signal provided to the microprocessor from the voltage dividers formed between the sensor conductors of the heater wires and either the capacitor or resistor will vary in phase or voltage relative to the temperature of the heater wires. The microprocessor controls the duty cycle of the power signal provided to the heater wires.

12 Claims, 20 Drawing Sheets

(56) References Cited

U.S. PATENT DOCUMENTS

| | | | | |
|---|---|---|---|---|
| 4,547,658 | A | 10/1985 | Crowley | 219/539 |
| 5,861,610 | A | 1/1999 | Weiss | 219/497 |
| 6,222,162 | B1 | 4/2001 | Keane | 219/481 |
| 6,310,332 | B1 * | 10/2001 | Gerrard | H05B 3/56 219/212 |
| 6,355,912 | B2 | 3/2002 | Allard | 219/481 |
| 6,653,607 | B2 * | 11/2003 | Ellis | A61F 7/007 219/212 |
| 6,737,610 | B1 | 5/2004 | Horn et al. | 219/212 |
| 6,927,369 | B2 * | 8/2005 | Merk | H05B 3/342 219/494 |
| 7,106,048 | B1 | 9/2006 | Feight et al. | 324/127 |
| 7,180,037 | B2 | 2/2007 | Weiss | 219/505 |
| 2003/0052121 | A1 | 3/2003 | Sopory | 219/505 |
| 2003/0173345 | A1 | 9/2003 | Irwin, Sr. et al. | 219/212 |
| 2005/0109752 | A1 | 5/2005 | Merk et al. | 219/212 |
| 2005/0263518 | A1 | 12/2005 | Weiss | 219/482 |
| 2006/0196868 | A1 | 9/2006 | Yang | 219/505 |
| 2015/0014303 | A1 * | 1/2015 | Kohler | H05B 1/0252 219/544 |

OTHER PUBLICATIONS

Kruger, A., "*What is a resettable (PPTC) fuse, and how does it work?*" 2004, http://old.iihr.uiowa.edu/~hml/people/kruger/Publications/ChipCenter/pptc01.pdf (no longer active).

* cited by examiner

HEATER WIRE SAFETY CIRCUIT

CROSS-REFERENCE TO RELATED APPLICATIONS

This application is a continuation-in-part of U.S. patent application Ser. No. 13/306,030, which was filed on Nov. 29, 2011, and is entitled "Heater Wire Safety Circuit", and is related to U.S. Provisional Application Ser. No. 61/458,668, which was filed on Nov. 29, 2010, and is entitled "Heater Wire Safety Circuit", and U.S. Provisional Application Ser. No. 61/516,802, which was filed on Apr. 8, 2011, and is entitled "Heater Wire Safety Circuit", the disclosure of each of which is hereby incorporated by reference and on which priority is hereby claimed.

BACKGROUND OF THE INVENTION

1. Technical Field

The technical field includes all electrical heating and safety systems, particularly heating pads and electric blankets that include safety systems for overheat protection under abnormal use conditions.

2. Description of the Prior Art

Electric heating pads are put through numerous abnormal conditions by consumers. To ensure their safety, an overheat safety protection element is commonly included. It is not uncommon for a consumer to unintentionally abuse the product by bunching, twisting and folding the product. While heating pads or electric blankets need to meet consumer demands with faster preheats, higher temperatures and improved comfort, they also need to meet safety requirements with safety circuits and smart wire construction.

Modern flexible heating wire, such as used in electric blankets and heating pads, senses the wire temperature and provides a feedback signal to the control to control both the temperature and safety of the product. The present inventor has several inventions in the area of temperature control and safety of flexible heating wire that use the characteristics of the wire in combination with an electronic control circuit to accomplish temperature control and safety. Weiss U.S. Pat. No. 5,861,610 discloses a heater wire for use in a heating pad and electric blanket, which heater wire includes a sensor wire. An electronic control senses the resistance change with temperature of the sensor wire, and the electronic control also looks for a voltage indicating a meltdown of the inner insulation. Keane U.S. Pat. No. 6,222,162 discloses an electric blanket having a heater wire, and a control that measures the resistance change of the heater wire using a series resistor without a separate conductor. Though the method disclosed in the aforementioned Keane patent can sense the average temperature of the wire, it is limited because hot spots due to bunching or abnormal folding are not sensed. Gerrard U.S. Pat. No. 6,310,332 discloses a heating blanket which uses a combination of a low melt NTC (negative temperature coefficient) layer and a series resistor to control and sense hot spots. The heater wire is powered under one-half (½) cycles, and the sensor wire looks for current in the other half cycle to sense a wire hot spot. Weiss U.S. Pat. No. 7,180,037 discloses a heater wire and control for use in a heating pad and electric blanket that use a separate sensor wire and an NTC layer between the sensor wire and heater wire that conducts current when the first insulation layer becomes hot and also monitors the temperature of the heater wire itself. Temperature sensing of both the NTC layer and the heater wire is accomplished without a series resistor by a phase shift measurement. Systems that include an NTC (negative temperature coefficient) polymer as the insulator for both the function of the circuit and program (software) involved in the safety aspects of the control utilize analog circuits and a microcontroller. Multiple critical components are often identified whose tolerance and manufacturer supply are specified. The failure mode analysis is based on the accumulated failure rates of these multiple critical components, including the microprocessor and solid state switches, such as triacs. The more components that contribute to the safety circuit result in a shorter time between failures. The ingenious circuits that have a reduced number of critical components and also provide improved wire fault detection have led to the success of "smart wire" systems. The disclosures set forth in each of the above-identified patents are incorporated herein by reference.

The extensive approval process in combination with diverse product offering and a short technology life cycle has hampered the cost effectiveness of introducing new technology, i.e., a heating pad or electric blanket having a different shape and wattage approved on an individual model basis is expensive and the approval process is lengthy. Layers of redundant safety systems come at a price, although the reliance on sophisticated electronics is a safety improvement over the traditional mechanical thermostat systems. The consumer is not always willing to pay additional for features that are transparent, resulting in the less reliable mechanical temperature control products that are still evident in today's lowest cost heating pads.

OBJECTS AND SUMMARY OF THE INVENTION

It is an object of this invention to provide a simple, low cost system to regulate the temperature of products that employ flexible heater wire and to passively interrupt the power to the heater wire when a fault or over-temperature condition exists at any location along the length of the wire.

It is another object of the present invention to provide a heating pad and electric blanket that overcomes the inherent disadvantages of conventional heating pads and electric blankets.

In accordance with one form of the present invention, a heater wire safety circuit for use with an electric blanket or heating pad includes a heater conductor to provide heat to the electric blanket or heating pad over at least a portion thereof. A low resistive conductor is situated in proximity to the heater conductor along at least a portion of the length of the heater conductor. A low melt insulate layer is situated between the heater conductor and the low resistive conductor along at least a portion of the length of the heater conductor. The resistance of the low resistive conductor is much less than that of the heater conductor.

In one embodiment of the safety circuit, a pair of diodes are connected between the heater conductor and the low resistive conductor, one diode being situated at one end of the heater conductor and low resistive conductor, and the other diode being situated at the other end of the heater conductor and low resistive conductor, with the diodes being oriented so that no current normally flows through the low resistive conductor. However, if a hot spot occurs in the electric blanket or heating pad anywhere along the length of the heater conductor situated within the electric blanket or heating pad which exceeds a predetermined temperature, the low melt insulate layer will melt at that hot spot so that the heater conductor and low resistive conductor contact each other. The low resistance of the low resistive conductor will short out the higher resistance of the heater conductor to conduct more current through the low resistive conductor than is normal. This will cause a fuse connected to the heater conductor to open, thereby preventing further current from flowing into the electric blanket or heating pad.

In an alternative form of the present invention, a dual heater wire circuit is provided for use with a heating pad or electric blanket. Each heater wire circuit includes a heater wire and a temperature sensor conductor wrapped about the heater wire. The temperature sensor conductor of each heater wire circuit is connected to a capacitor, or to a resistor, to define with the capacitor or resistor a voltage divider circuit. The juncture between the sensor conductors and either the capacitor or the resistor is provided to the input of a microprocessor. The temperature sensor conductors of the heater wires exhibit a positive temperature coefficient so that their electrical resistance increases with increasing temperature of the heater wires. Thus, the signal provided to the microprocessor from the voltage dividers formed between the sensor conductors of the heater wires and either the capacitor or resistor will vary in phase or voltage relative to the temperature of the heater wires of the heating pad or electric blanket. In response, the microprocessor, through a triac connected to the heater wires of the heater wire circuits, can control the duty cycle of the power provided to the heater wires in the positive and/or negative half cycles of the power supplied to the heating pad or electric blanket.

In another alternative version of the present invention similar to the circuit described above, the heater wires themselves may be formed from a material which exhibits a positive temperature coefficient of resistance, and the heater wires may be connected to the capacitor or resistor to form the voltage divider circuit so that the microprocessor can detect a phase shift or change in voltage which is indicative of a change in the temperature of the heater wires of the heater wire circuits within the heating pad or electric blanket.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 13:
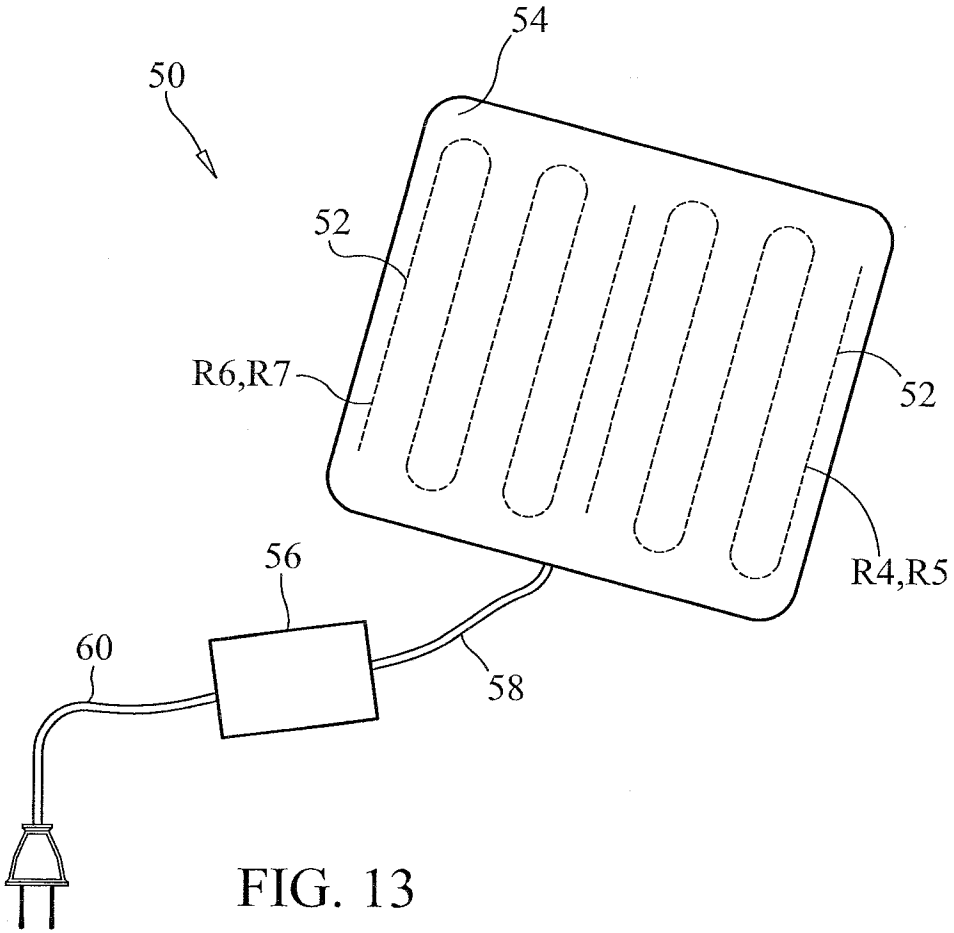
FIG. 13 is a perspective view illustrating a heating pad or electric blanket formed in accordance with the present invention.

Referring initially to FIG. 13 of the drawings, it will be seen that a heating pad or electric blanket 50 formed in accordance with the present invention includes an elongated heater wire 52 also formed in accordance with the present invention, within an outer covering 54, which is preferably formed of cloth. A control unit 56, also referred to herein as a "control", is operatively coupled to the heater wire 52 to control the power provided to the heater wire and thus the temperature of the heating pad or electric blanket 50. This control unit 56 may be connected to the heating pad or electric blanket by a control cord 58 having one or more electrical wires, the control cord 58 being separate from the power cord 60 providing 120 volts AC power to the heater wire 52 within the heating pad or electrical blanket 50. Alternatively, the control unit 56 may be electrically connected to the power cord 60, with the 120 volts AC power being provided to the heating pad or electric blanket 50 by wires within the control cord 58 connected to the heating pad or electric blanket 50, as shown in FIG. 13. Portions of heating wire safety circuit of the present invention, as will be described in greater detail, may be incorporated in the control unit 56, or may be incorporated directly within or at the heating pad or electric blanket 50.

Figure 11:
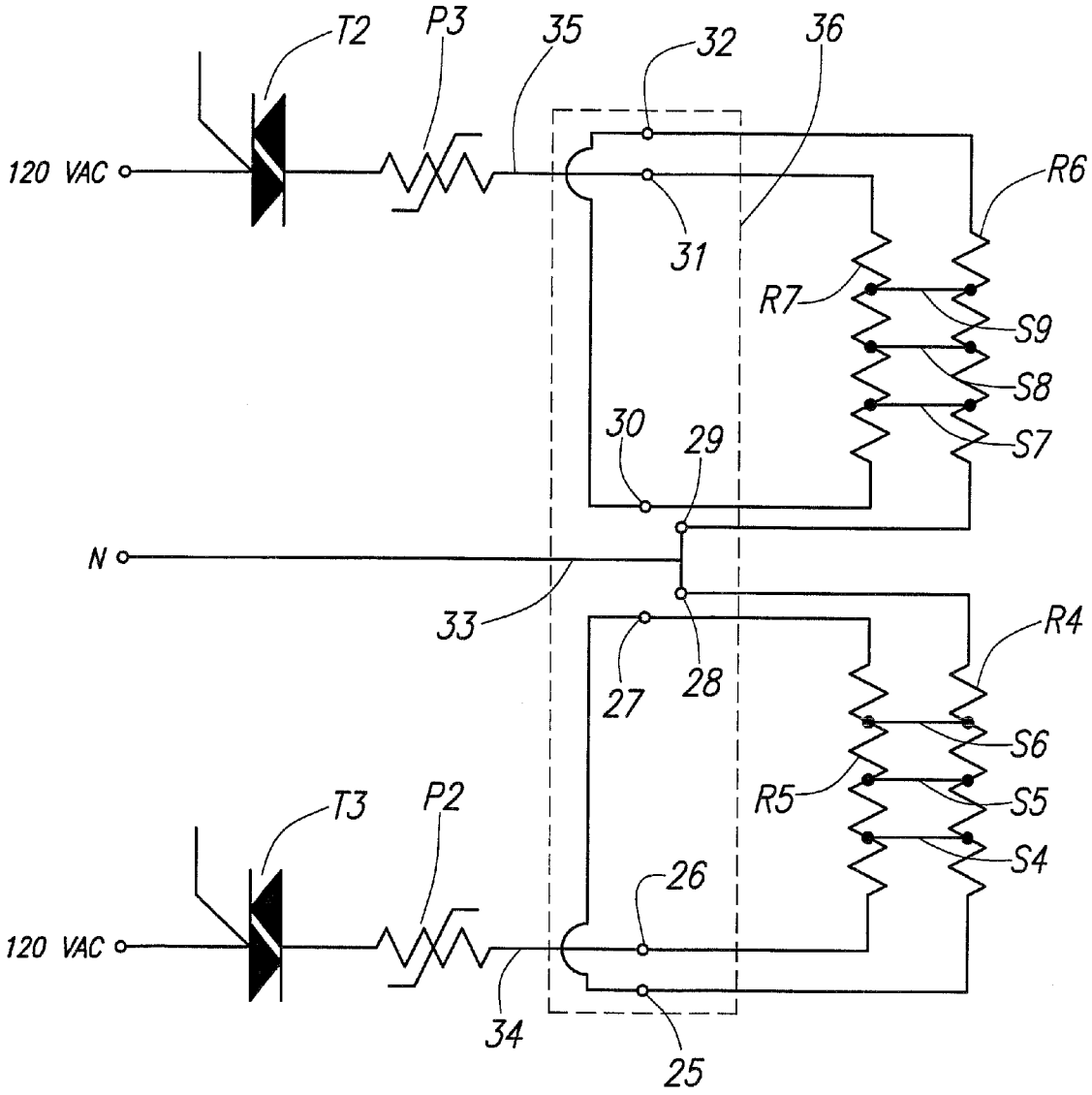
FIG. 11 is a schematic diagram of a dual circuit heater circuit formed in accordance with a preferred embodiment of the present invention.

The heating pad or electric blanket 50 shown in FIG. 13 is depicted with two heater circuits having heater wires 52, such as shown schematically in FIG. 11, where one heater wire 52 has two heater conductors 1', 3' having resistances R4 and R5

(see FIG. 11), and the other heater wire 52 also has two heater conductors 1', 3' having resistances R6 and R7.

Figure 1:
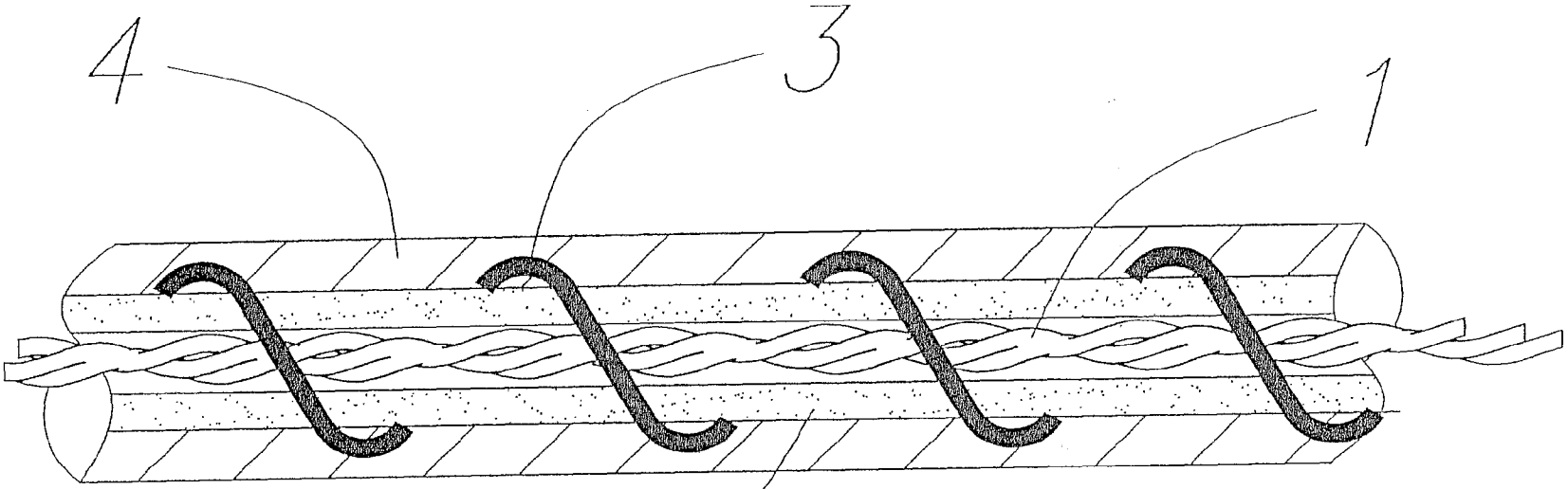
FIG. 1 is a constructional perspective view of the wire used in the present invention.

Referring now to FIG. 1, and in accordance with the present invention, it will be seen that an elongated heater wire 52 is constructed having a Copper tinsel core 1. The tinsel core 1 is comprised of multiple ribbon strands for flexibility and to have a low resistance value. The core is preferably on the order of about 0.8 ohms (Ω) per meter. Surrounding the tinsel core is extruded a low melt polymer insulate layer 2, such as polyethylene, that has a melting point of preferably about 130° C. Wound around the low melt insulate layer 2 is a heater conductor 3, made from a metal or alloy having a high change of resistance with temperature. This property is known as the coefficient of thermal resistance, or thermal coefficient resistance (TCR). Nickel (95%) exhibits a TCR of 0.5% per ° C. Copper is also suitable, having a TCR (thermal coefficient resistance) of 0.39% per ° C. Outside the heater conductor is extruded the outer insulation 4 preferably made of flexible polyvinylchloride (PVC). The heater wire is sized to provide heat when current is applied. As the temperature of the heater conductor 3 increases, the resistance also increases; the overall resistance of the heater conductor 3 is an indication of the temperature of the wire. This type of wire is available from Thermocable LTD in the U.K. and is designated Model No. TD500.

Figure 2:
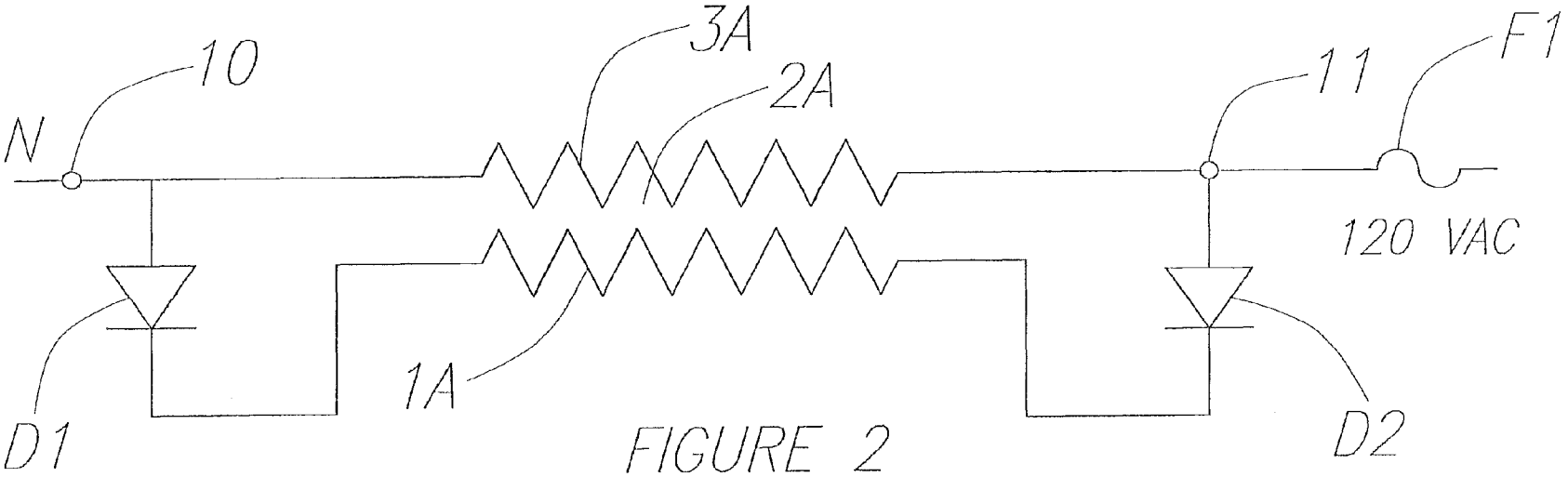
FIG. 2 is a schematic diagram of the wire configuration of a single circuit powered by full wave AC line voltage formed in accordance with the present invention.
Figure 4:
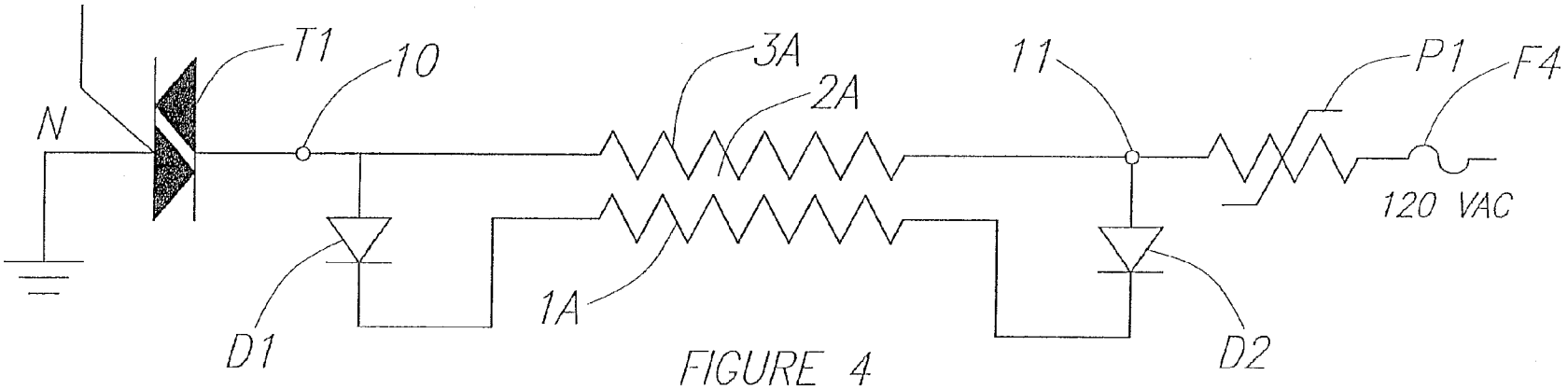
FIG. 4 is a schematic diagram of a safety overheat protection circuit formed in accordance with the present invention and including switching and limiting components.

The heater conductor 3 of the wire configuration shown in FIG. 1 may be connected to a circuit that senses an over current condition through the heater conductor, such as a polymetric positive temperature coefficient (PPTC) device, such as device P1 shown in FIG. 4, or a fuse, such as fuse F4 shown in FIG. 2, to reduce or prevent (by using a triac, such as triac T1 shown in FIG. 4, or another switching device or circuit) the flow of current through the heater conductor. Alternatively, a sensing resistor, such as resistor R10 in FIG. 12, may be used in series with the heater conductor 3. The voltage across the sensing resistor may be sensed by a microprocessor or comparator and compared to a reference voltage to determine if an over current condition through the heater conductor exists.

Figure 3:
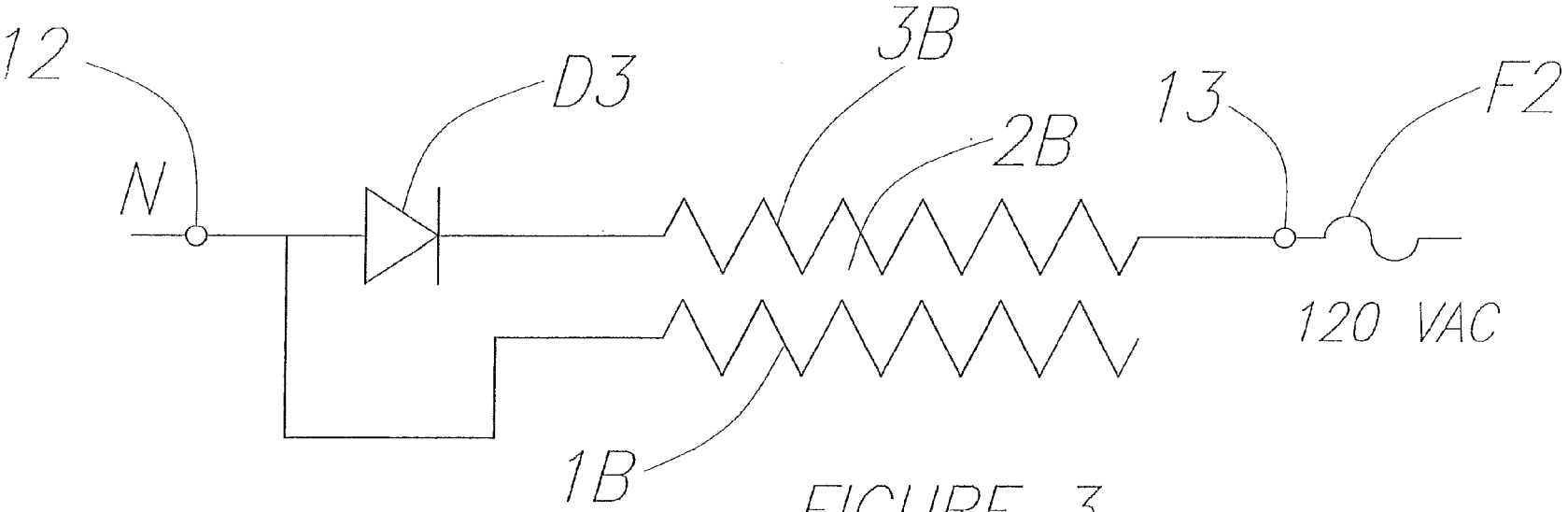
FIG. 3 is a schematic diagram of the wire configuration of a single circuit powered by half wave AC line voltage formed in accordance with the present invention.

Schematically, the wire can be configured several ways as illustrated in FIG. 2 and FIG. 3. First, consider the configuration of FIG. 2, where reference number 3A represents the heater conductor 3 and reference number 1A represents the low resistive core 1. The low melt insulate layer 2A is shown as a space between the heater conductor 3A and resistive core 1A. Two diodes, D1 and D2, at opposite ends of the heater conductor 3A and low resistive conductor core 1A, connect both conductors 3A, 1A in polar opposite directions, i.e., connected cathode to cathode through core 1 (1A), as shown in FIG. 2, or anode to anode through core 1 (1A). Under normal conditions with AC voltage applied across the heater conductor 3A located between the neutral (N) power line at node 10 and the 120 VAC (hot) power line at node 11, the diodes D1 and D2 block current in both the first and second half cycles, isolating the core 1A and the heater conductor 3A. The low melt insulate layer 2, shown in FIG. 1, or 2A in FIG. 2, is preferably about 0.015" thick, and provides adequate electrical insulation under normal conditions; however, should any section of the low melt insulate lay 2 (2A) overheat to a temperature of 130° C., then it will melt and allow the heater conductor 3A to move and touch the low resistive core 1A, effectively creating a short across both isolating diodes D1 and D2. Since the resistance of core 1A is negligible compared to the resistance of heater conductor 3A, preferably on the order of about 1/200 as a ratio of their resistances, the current through the parallel arrangement of the heater conductor 3A and the low resistive core 1A will increase by at least two times. In the simplest form of the circuit, a fuse F1 in series with the 120 VAC power line is sized to open with higher than normal current. In FIG. 2, the letter "N" represents the neutral wire.

Alternatively, the heater conductor 3B can be powered by half cycle, schematically illustrated in FIG. 3. In this case, the diode D3 is connected in series at its cathode (or, alternatively, its anode) with one end of the heater conductor 3B. The other end of the heater conductor 3B is connected at node 13 to fuse F2. The anode (or, alternatively, the cathode) of diode D3 is connected to the neutral (N) power line and to one end of the low resistive core 1B, whose other end is open (not connected to the circuit). As in the embodiment shown in FIG. 2 and described previously, heater conductor 3B is separated from low resistive core 1B by a low melt insulate layer 2B.

The diode D3 is shunted as the low melt insulate layer 2B melts and shorts at any place along the heater conductor 3B between the heater conductor 3B and the low resistive core 1B, wherein the current at least doubles, and as described above, will open the fuse F2 in series with the 120 VAC power line. The advantage of this arrangement over the circuit of FIG. 2 is when long length heater wire is used. Should the meltdown of the low melt insulate layer 2B occur near the neutral side N, close to the diode D3, then the current doubles by introducing the negative half cycle. If the meltdown of the low melt insulate layer 2B occurs farther toward the high voltage 120 VAC end at node 13, then the current more than doubles as the low resistive core 1B also shunts the heater conductor 3B on the neutral (N) side at node 12 of the meltdown. Electric blankets typically have 23 to 30 meters of heater wire and would benefit from this arrangement.

FIG. 4 illustrates a more complete arrangement of the circuit of the present invention schematically shown in FIG. 2 that employs a solid state switch (e.g., a triac) T1 connected in series between the neutral (N) power line and node 10, and a Polymetric Positive Temperature Coefficient device P1 connected in series between fuse F4 in line with the 120 VAC power line and node 11. The Polymetric Positive Temperature Coefficient device P1 is otherwise known as a PPTC device, as it will be referred to hereinafter. This PPTC device P1 acts as a resettable fuse. The fuse F4 in this case is preferably sized greater than about two times the normal current, and the PPTC device P1 is preferably sized to enter the high resistance state with less than two times the normal current. This arrangement will survive short transient current surges and also the higher current that is typical upon startup of the positive resistance change of the heater conductor 3 (3A in FIG. 4). A solid state switch, such as a triac T1, is controlled by a control circuit within control unit 56, and switches off (or on) the power to the heater wire supplying 120 VAC across the heater conductor 3A based on the temperature of the heater conductor, pad or blanket. As the heater conductor 3A heats, the resistance thereof increases and the current decreases until a steady state current is reached. The PPTC device P1 remains in a current hold state having low resistance. If the heater wire is bunched and subsequently heat builds up at the point of the bunch, such as an insulated overlapping wire condition, a meltdown of the insulate layer 2A occurs and the heater conductor 3A shorts to the low resistive core 1A, causing the current to at least double. Within a few seconds, the PPTC device P1 will change state to a high resistance. The current is thereby substantially reduced yet is sufficient to keep device P1 in a high impedance state. The PPTC device P1 is sized according to a hold current and a trip current. The trip current of the PPTC device P1 needed to change the device P1 from a low resistance state to a high resistance state is typically about two times the aforementioned hold current.

The hold current is the current required to maintain the PPTC device P1 in a low resistance state. A wire temperature sensing circuit (not shown), which may be situated within control unit 56, and having a sensing wire or resistor (also not shown) within the heating pad or electric blanket 50, in the case of a short will continue to trigger the triac T1, ensuring that the PPTC device P1 will soon transform into a high impedance state, going from, for example, 0.5 ohms to 4K ohms. The heating pad or electric blanket 50 incorporating the safety circuit of the present invention will then no longer produce noticeable heat and the hot spot will cool. The advantage of this method of hot spot detection is that a very small percentage of the heater conductor 3A that overheats will cause the tripping of the PPTC device P1. Another advantage is that the hot spot detection and subsequent reduction of power to the heater conductor 3A are independent of the control circuit of unit 56 (including the wire temperature sensing circuit) for the heating pad or electric blanket 50. Regardless of any failure of the control circuit of unit 56 that may occur, the safety circuit of the present invention as described will limit the power to the heater conductor 3A upon an overheat condition any place along the entire length of the conductor 3A. Only two junctions 10 and 11 are required to connect the control circuit within unit 56 to the heater conductor 3A. The diodes D1 and D2 are preferably located within the heating pad or electric blanket 50, typically in the connector at the electric blanket or pad 50 which connects the control cord 58 thereto. Therefore, the control cord 58 to the product becomes a two wire connection. Other "smart wire" circuits such as were previously described in the Background section require three or four wires to connect the control circuit to the heating pad or electric blanket.

Figure 5:
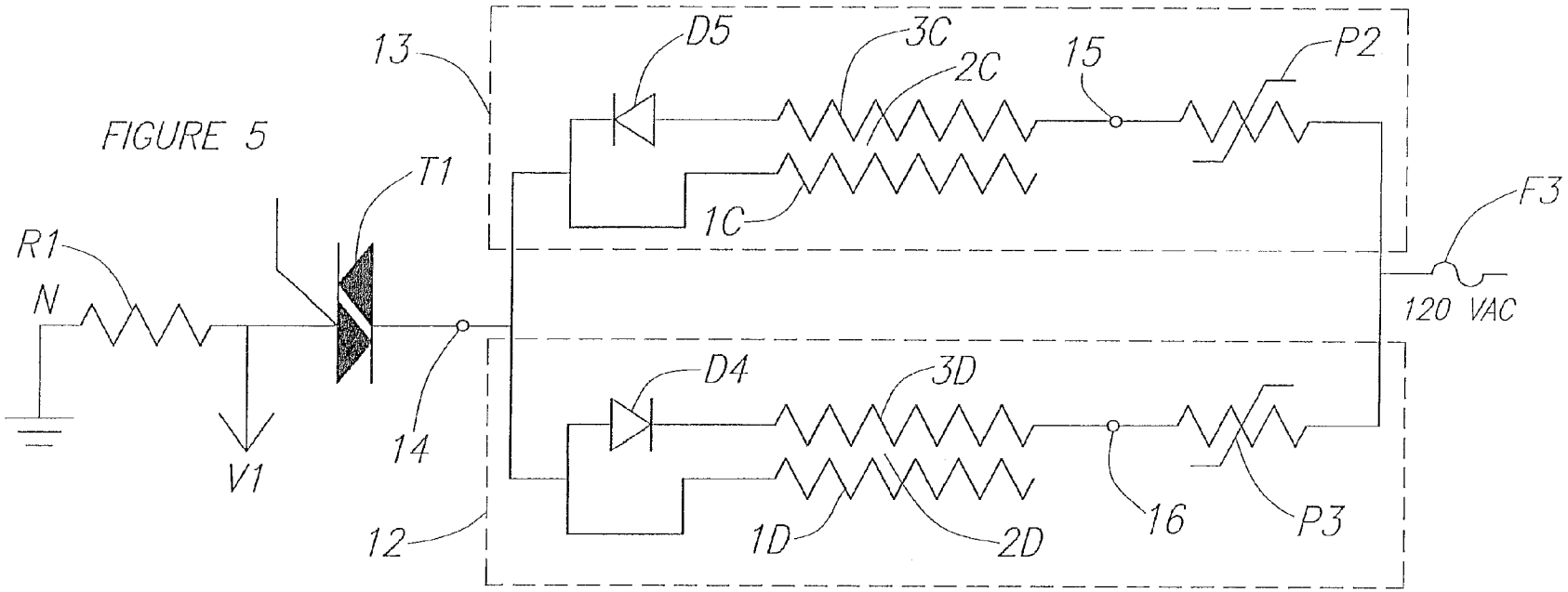
FIG. 5 is a schematic diagram of a dual heater circuit, having a series resistor for monitoring the heater temperature, formed in accordance with the present invention.

An example of a dual temperature and safety circuit of the present invention is shown in FIG. 5. Several temperature control methods can be used and are not relevant to the operation of the safety circuit. For simplicity, the schematic of FIG. 5 is shown with a series resistor R1 interposed between the neutral (N) power line and a triac T1 connected to node 14 of the dual circuit. Node 14 is connected to the cathode of diode D5 of the second heater circuit 13 and to the anode of diode D4 of the first heater circuit 12. The anode of diode D5 of the second heater circuit 13 is connected to one end of heater conductor 3C, whose other end is connected to node 15. The cathode of diode D5 is connected to one end of the low resistive core 1C, whose other end is open-circuited. Low melt insulate layer 2C separates the heater conductor 3C from the low resistive core 1C when the second heater circuit 13 is operating normally.

Similarly, in the first heater circuit 12, the triac T1 is connected at node 14 to the anode of diode D4, whose cathode is connected to one end of heater conductor 3D. The other end of heater conductor 3D is connected to node 16. The anode of diode D4 is connected to the low resistive core ID, whose other end is open-circuited. Low melt insulate layer separates the heater conductor 3D from the low resistive core 1D when the first heater circuit 12 is operating normally.

The voltage V1 across the series resistor R1 decreases as the impedance of the heater conductors 3C and 3D increases. Two circuits are shown, 12 and 13, both of which are powered by opposite half cycles, the first heater circuit 12 being similar to the embodiment shown in FIG. 3 and powered by the first half cycle, and the second heater circuit 13 also being similar thereto but with the diode D5 reversed to the diode D4 of the first circuit 12 so as to be powered by the second half cycle. A single triac T1 is triggered to switch the power on both heater conductors 3D and 3C. Thus, heater conductor 3C of the second circuit 13 is powered in the second half cycle, and heater conductor 3D of the first circuit 12 is powered in the first half cycle, with series diodes D4 and D5 in series with the conductor wires 3D and 3C, respectively.

In this arrangement, two PPTC devices P3 and P2 are used, one device in each circuit 12, 13, and one fuse F3, although two separate fuses can be used, one for each circuit 12, 13. More specifically, one PPTC device P3 in the first heater circuit 12 is connected between node 16 and fuse F3. The other PPTC device P2 in the second heater circuit 13 is connected between node 15 and fuse F3. The other end of fuse F3 is connected to the 120 VAC power line. The control logic of the control circuit of unit 56 can be independent or can be based on the hottest of circuits 12, 13. If both circuits 12, 13 are the same temperature, then the temperature control circuit will allow the most power to a heater circuit regardless of the imbalance of the heater load. For example, if one circuit 12 or 13 is insulated, and the other circuit 13 or 12 is not, then the power is reduced according to the hottest, insulated side. The voltage is monitored across resistor R1 for each half cycle by the control circuit in unit 56. When the voltage across resistor R1 goes below a threshold differential in either half cycle, then the triac T1 is turned off, reducing heat to the pad or blanket 50. Periodically, the triac T1 is turned on to sense the resistor R1 voltages. If for opposite half cycles the voltages across resistor R1 are both over a predetermined threshold, then the triac T1 is switched back on and both circuits 12, 13 heat. If a hot spot occurs anywhere along the heater conductor 3D and low resistive core 1D of circuit 12, then the PPTC device P3 will go to a high impedance state. Concurrently or independently, should a hot spot occur anywhere along the heater conductor 3C of the other circuit 13 and a short occurs between heater conductor 3C and low resistive core 1C, then the PPTC device P2 will go into a high impedance state. Fuse F3 is selected to open at a greater current than the trip current for either PPTC device P2 or P3. In this embodiment, a three wire connection having junction 14 to the power switching side and junctions 15 and 16 to the 120 VAC side is shown. A three conductor control cord 58 leading to the control circuit in control unit 56 is thus used for driving the two separate circuits. Also, the PPTC devices P3 and P2 are preferably located in the external control unit 56, but may be located in the safety circuit situated within the heating pad or electric blanket 50.

Figure 6:
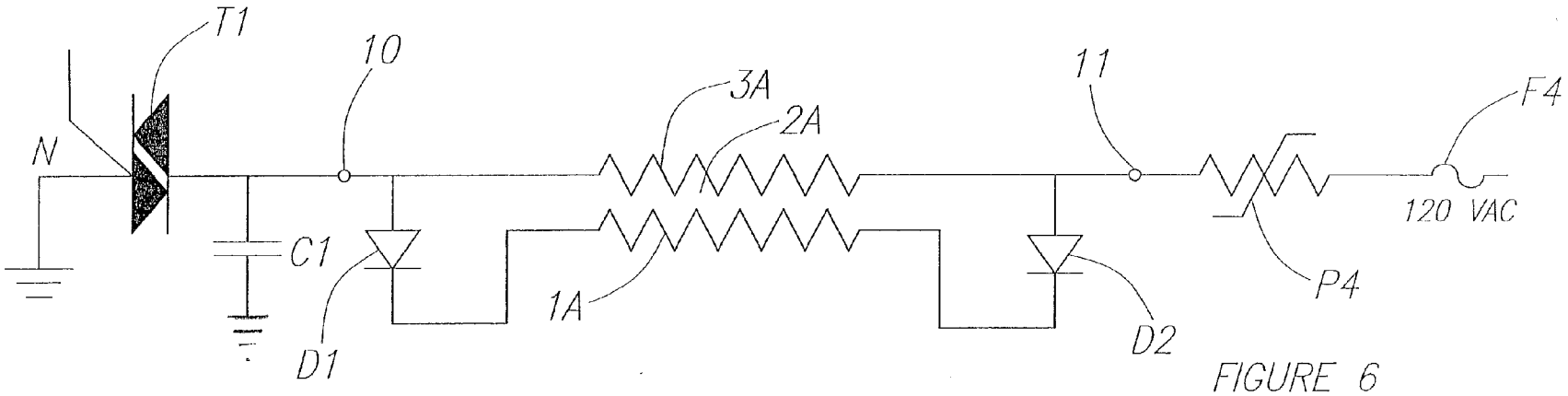
FIG. 6 is a schematic diagram of a single heater circuit having a phase shift capacitor to monitor the heater temperature, formed in accordance with the present invention.

Many temperature control methods can be used and the same principles apply. FIG. 6 shows the circuit shown schematically in FIG. 4 that uses a phase shift capacitor C1 coupled between ground (neutral) and node 10 and triac T1 in a voltage divider arrangement with the heater conductor 3A. As the temperature of the heater wire 3A increases, the phase of the zero crossing at node 10 increases relative to the input power zero crossing. This method is described in detail in Weiss U.S. Pat. No. 7,180,037 mentioned previously, the disclosure of which is incorporated herein by reference. If any hot spot occurs along the heater conductor 3A and low resistive core 1A that causes the insulate layer 2A to melt, a short in turn causes the PPTC device P4 (P2 in FIG. 4) to trip irrespective of the control system used. The advantage of using a phase detection method in combination with the present safety circuit invention described herein over the series resistor method of the embodiment shown in FIG. 5 is that the capacitor circuit will not produce heat that affects the trip point of the PPTC device P4; however, tolerances of the trip point in either control method of the embodiments shown in FIG. 5 and FIG. 6 are well within the working range.

Referring again to FIG. 4 and the case where the hot spot and resulting short is at either end of the heater conductor 3A, a high current will exist and may exceed the maximum current of the PPTC device P1 or triac T1 before the fuse F4 opens. Also, if either of diodes D1 or D2 fails to open or is poorly soldered, the current increase may not be enough to trip device P1. For a product such as heating pads or electric blankets 50 with production volumes in the millions, component and workmanship failures need to be considered. The diode circuit of the present invention illustrated in FIG. 7 solves both the problem of over current and component failure.

Figure 7:
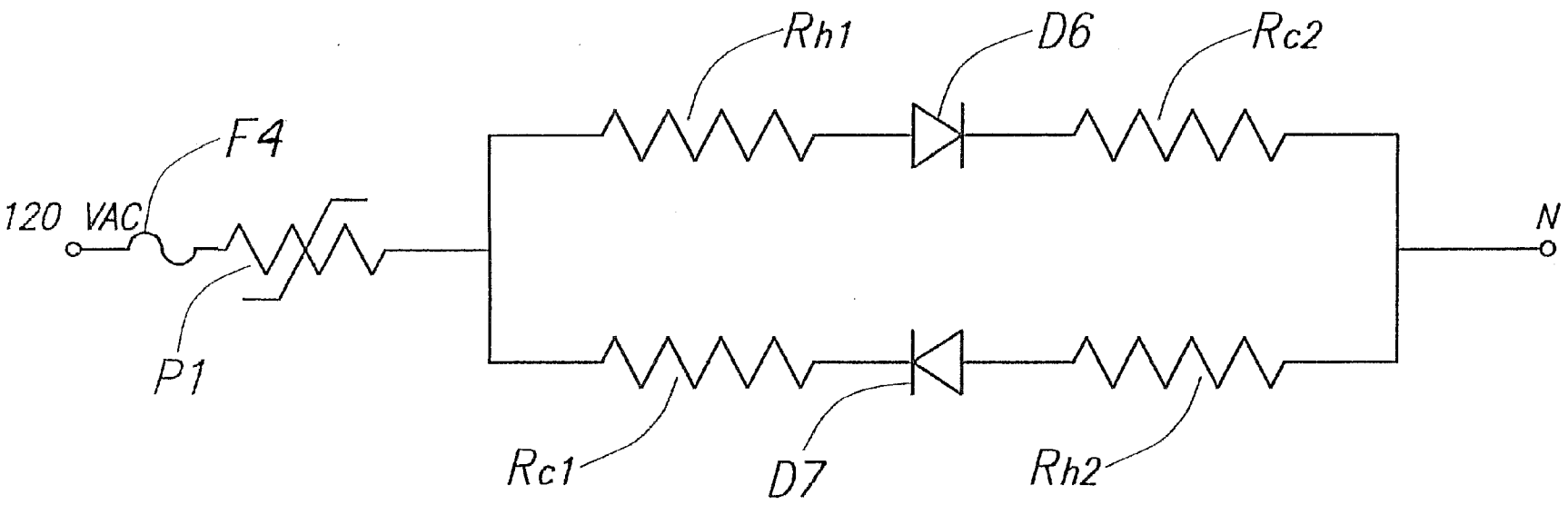
FIG. 7 is a schematic diagram of a single circuit with a pair of shifting diodes between the heater and core, formed in accordance with the present invention.

The diode pair in the circuit of FIG. 7 is located preferably in the middle of the heater wire. The heater conductor Rh1 of the first half of the heater wire is connected through diode D6 to the low resistive core Rc2 of the opposite second half of the heater wire, and the heater conductor Rh2 of the second half is connected through diode D7 to the low resistive core Rc1 of the first half of the heater wire.

More specifically, the 120 VAC power line is connected through a fuse F4 to one end of a PPTC device P1, whose other end is connected to a first end of the first half section Rh1 of the heater conductor 3. The second end of the first half section Rh1 of the heater conductor 3 is connected to the anode (or, alternatively, the cathode) of diode D6 preferably placed in the middle of the length of the heater conductor 3. The cathode (or, alternatively, the anode) of diode D6 is connected to a first end of the second half section Rc2 of the low resistive core. The second half section Rh2 of the heater conductor 3 is wrapped about the second half section Rc2 of the low resistive core 1 and separated therefrom by the low melt insulate layer 2. Similarly, the first half section Rh1 of the heater conductor 3 is wrapped about the first half section Rc1 of the low resistive core 1 and separated therefrom by the low melt insulate layer 2.

The second end of the second half section Rc2 of the low resistive core 1 is connected to the neutral (N) power line, which is also connected to the first end of the second half section Rh2 of the heater conductor 3. The second end of the second half section Rh2 of the heater conductor 3 is connected to the anode (or, alternatively, the cathode) of diode D7 preferably also placed in the middle of the length of heater conductor 3, like diode D6. The cathode (or, alternatively, the anode) of diode D7 is connected to the first end of the first half section Rc1 of the low resistive core 1. The second end of the first half section Rc1 of the low resistive core 1 is connected to the PPTC device P1 and to the first end of the first half section Rh1 of the heater conductor 3.

Because the resistances of heater conductor sections Rh1 and Rh2 are substantially higher than the resistance of the core sections Rc1 and Rc2, as previously described, the current is effectively doubled for a short at any location along the heater wire, and an over current condition is thus avoided. An open heater wire, core or diode can be detected, as no current exists in either the positive or negative half cycle.

Figure 8:
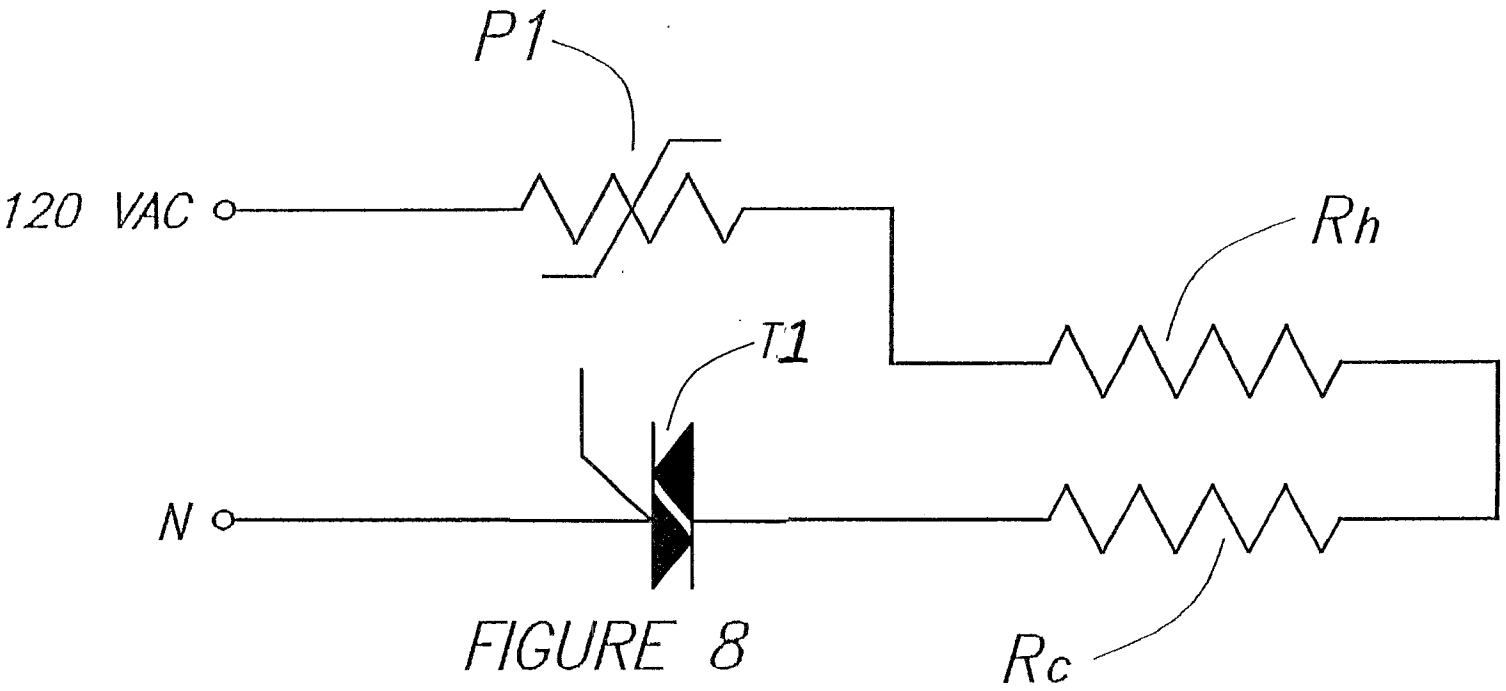
FIG. 8 is a schematic diagram of a single heater circuit with the heater conductor and core connected, formed in accordance with the present invention.

FIG. 8 shows an even simpler form of a heater wire safety circuit than that shown in FIG. 7. The heater conductor Rh is connected at a first end to one side of a PPTC device P1, whose other side is connected to the 120 VAC power line. The second end of the heater conductor Rh, near the far end of the heater wire opposite the 120 VAC power line, is connected to the first end of the low resistive core Rc, whose second end is electrically coupled to the neutral (N) power line preferably through a triac T1 or other switching device. The heater conductor Rh is wrapped about the low resistive core Rc over the length of the heater wire, and separated therefrom by the low melt insulate layer 2A. Thus, the heater conductor/resistive core connection is located at the far end of the heater wire.

Consider a hot spot short near the end of the wire, near where the line shown in FIG. 8 connects the heater conductor Rh and the core Rc together. In such a situation, the current will increase incrementally but will not increase enough to cause the PPTC device P1 to switch to a high resistance state; however, the short will cool the hot spot. In this case, the trip point of device P1 is designed to be just above the normal current of the heater conductor Rh. If the heater wire was controlled by the PTC effect of the heater conductor Rh, then the temperature of the effectively shorter wire would be out of tolerance. Also, a short near the beginning of the heater wire (to the left when viewing FIG. 8) will cause a high current that would exceed the maximum current of the device P1 and also the switching device, such as the triac T1 as described, or even a thermostat. The application of this circuit would therefore be limited. The elimination of the diode connections such as found in the embodiments shown in FIG. 8 would in this case be the only advantage outweighed by the disadvantages just described.

Figure 1A:
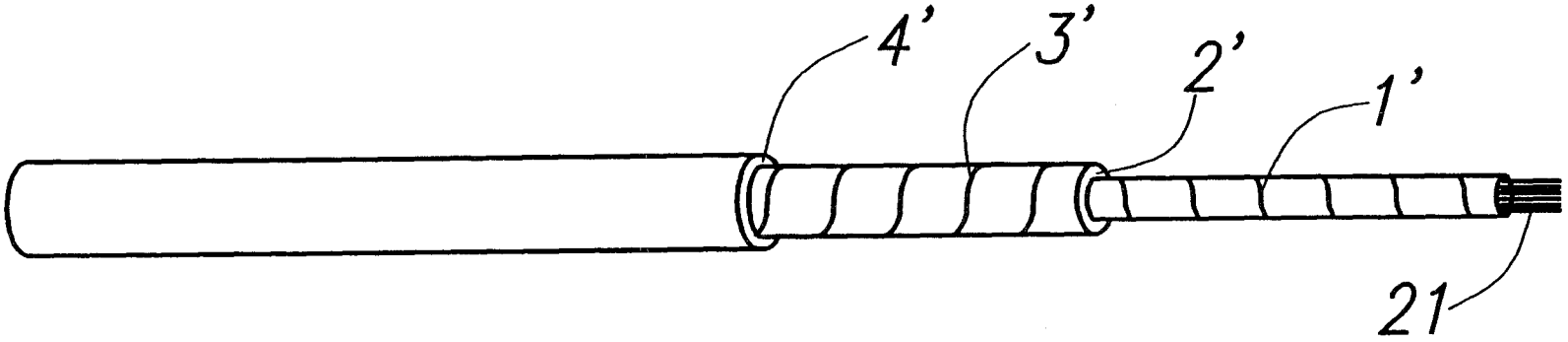
FIG. 1A is a constructional perspective view of an alternative version of the wire used in the present invention.
Figure 9:
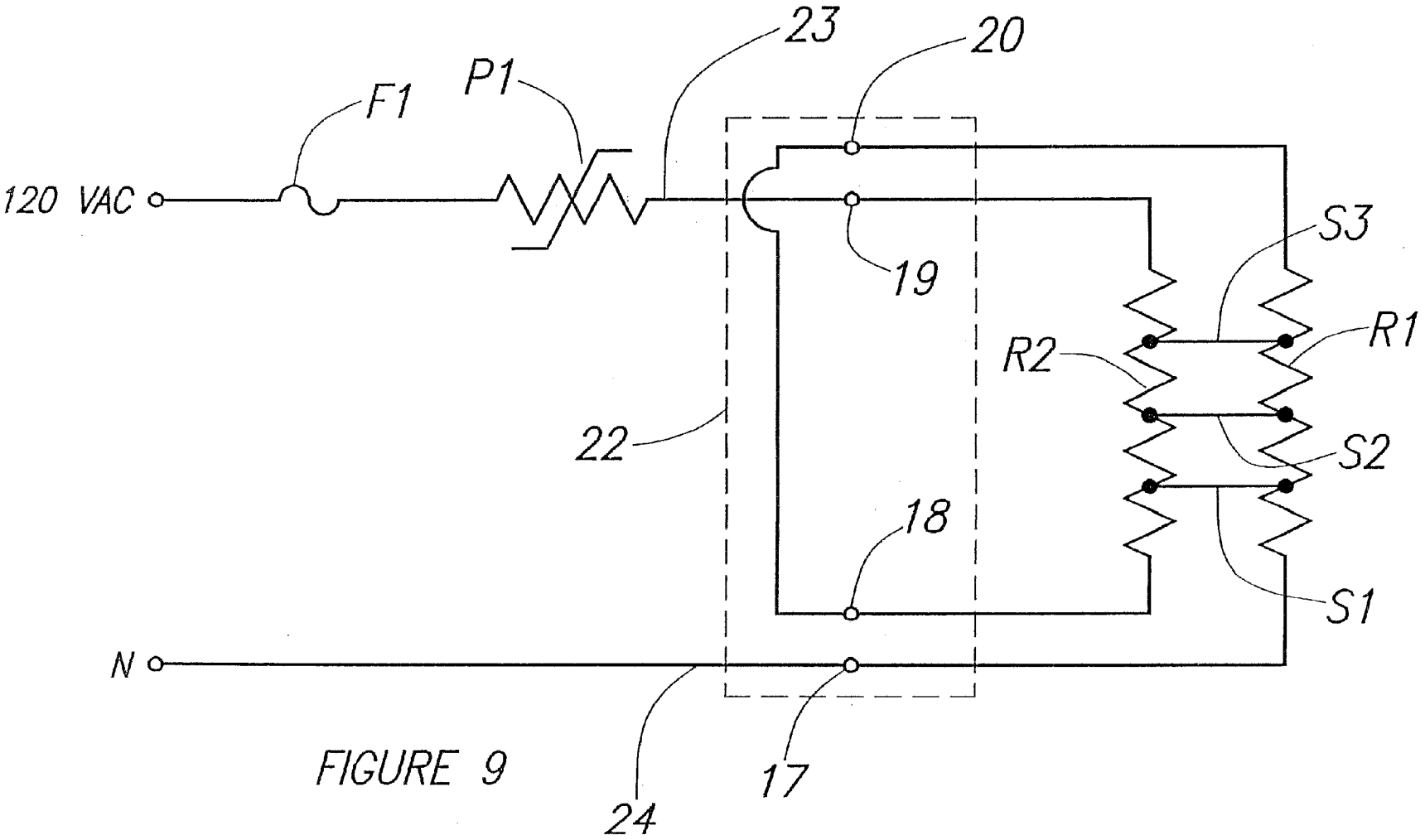
FIG. 9 is a schematic diagram of another preferred embodiment of the safety overheat protection circuit, with the core connected to the heater circuit in opposite polarity.

The heater wire safety circuit of the present invention shown in FIG. 9 in combination with the heater wire construction illustrated in FIG. 1A are herein described by way of example.

As shown in FIG. 1A, the heater wire of FIG. 1 is constructed by winding a first heater conductor 1' around a fiber core 21. A low melt insulate layer 2' is then extruded over the inner assembly fiber core 21 and conductor 1'. A second heater conductor 3' is counter-wound over the low melt insulate layer 2' in the opposite direction to the winding of the first heater conductor 1'. An outer insulative layer 4', preferably formed of polyvinylchloride (PVC), is then extruded over the dual heater wire assembly. A hot spot anywhere along the length of the heater wire will cause the low melt insulate layer 2' to melt and the conductors 1' and 3' to contact each other and short. The heater conductors 1' and 3' are made of a metal or alloy having a consistent temperature coefficient of resistance along their length, providing a feedback characteristic relative to the average temperature of the wire for temperature control. During normal use, the temperature of the entire heater wire will be controlled to a predetermined value. In an abnormal use condition, where the heater conductors are bunched or overlapped and insulated, the temperature of the bunched portion will rise above the average temperature until it reaches the melt temperature of the low melt insulate layer 2', which is selected preferably to be approximately 120° C., and the two heater conductors 1' and 3' make contact with each other. In the same or similar manner as described with respect to the heater wire shown in FIG. 1, one or both of the heater conductors 1' and 3' of the wire configuration shown in FIG. 1A may be connected to an over current sensing circuit (e.g., a fuse, PPTC device, sensing resistor, microprocessor or comparator), such as described, to reduce or prevent (such as by using a triac or other switching device or circuit) the flow of current through the heater conductor 1', 3'.

FIG. 9 shows the heater wire of FIG. 1A in schematic form with the inner heater conductor 1' represented by resistor R1 and the outer heater conductor 3' represented by resistor R2. The twin heater conductors 1' and 3' are connected in series at opposite ends (end-to-end) so that a voltage potential exists between the conductors at any point along the wire. To facilitate this discussion of the preferred configuration shown in FIG. 9, the heater conductors having resistances R1 and R2 are assumed to be of the same resistance value and are in a series relation. The combined resistance of conductors having resistances R1 and R2 comprises the normal resistance of the heater element. A connector or printed circuit board 22 provides the attachment of both heater conductors 1', 3' to the power supply conductors 23 and 24. A PPTC device P1 and fuse F1 are connected to each other in series, with the fuse F1 being also connected to the 120 VAC power line, and the PPTC device P1 being also connected to an end of the outer heater conductor 3' (i.e., resistance R2).

More specifically, in accordance with a preferred form of the present invention, and referring to FIG. 9 of the drawings, it will be seen that the 120 VAC power line 23 is connected through fuse F1 to PPTC device P1, which in turn is connected at node 19 on the printed circuit board 22 or connector to first end of the outer heater conductor 3' having resistance R2. The second end of the outer heater conductor 3' is connected at node 18 on the printed circuit board 22 or connector. Node 18 is connected to node 19 on the printed circuit board 22 or connector, to which is connected the first end of the inner heater conductor 1' having resistance R1. The second end of the inner heater conductor 1' is connected to node 17 on the printed circuit board 22 or connector, which is also connected to the neutral power line 24. Preferably, the fuse F1 and the PPTC device P1 are located within the control unit 56, and are in series with the twin conductor heating element.

Still referring to FIG. 9, the low melt layer 2' is shown as the space between conductors 1' and 3' respectively having resistances R1 and R2, and a melt or short is shown by lines S1, S2 and S3 at locations of 25%, 50% and 75% along the length of the heater wire. By way of example, values of resistances R1 and R2 of conductors 1' and 3' are both 87.75Ω each and 175.5Ω at room temperature, 20° C. When 120 VAC power is applied, the heater conductors 1', 3' increase in temperature and the resistance values increase due to the positive temperature nature of the conductor metal; in this case, a Nickel alloy is preferably used, having a temperature coefficient of resistance of 0.45% per ° C. A 100° C. increase in temperature would result in the total resistance (R1+R2) of conductors 1' and 3' increasing by 45%, or 175.5×1.45=254.47, at 120° C.

Consider a heating pad having the twin conductor heater wire of FIG. 1A designated in FIG. 9 by resistors R1 and R2, and with the space between conductors 1' and 3' (resistances R1 and R2) representing the low melt insulate layer 2'. Due to abnormal use and local overheating, a short occurs in the wire between conductors 1' and 3' (resistances R1 and R2), and the short is either at 25% along the wire length at location S1, 50% along the length of the wire at location S2, or 75% along the length of the wire at location S3. The current path for a short at point S1 includes 25% of conductor resistance R1 in series with 75% of conductor resistance R2, effectively reducing the resistance by 50% and increasing the current by two times. The same doubling of the current occurs for shorts at locations S2 and S3. The effective resistance values and corresponding fault currents are tabulated in Table 1 shown below. It should be noted that for any short at any point along the length of the heater wire, the current is doubled from 0.68 amps to 1.36 amps at 20° C. In the extreme case of the entire pad operating at 120° C., the conductor 1' resistance R1 and conductor 3' resistance R2 are increased by 45%, as described previously, and the fault current is 0.94 amps for any point along the heater wire. The actual working maximum design temperature of the pad is preferably 70° C. and is well within the startup temperature, room temperature and the extreme temperature of 120° C., which is preferably the low melt layer temperature of the wire. With the current limiting device P1 having a trip point of 0.80 amps, the current is limited for any condition of overheat expected to occur.

TABLE 1

| WIRE TEMPERATURE | NORMAL CURRENT | FAULT CURRENT | R1 Ω (OHM) | R2 Ω (OHM) | TOTAL (OHM) | CONDITION |
|---|---|---|---|---|---|---|
| 20° C. | .68 A | | 87.75 | 87.75 | 175.5 | NORMAL |
| 20° C. | 1.36 A | 1.36 A | 21.93 | 65.81 | 87.75 | Short at S1 |
| 20° C. | 1.36 A | 1.36 A | 43.87 | 43.87 | 87.75 | Short at S2 |
| 20° C. | 1.36 A | 1.36 A | 65.81 | 21.93 | 87.75 | Short at S3 |
| 120° C. | .47 A | | 127.24 | 127.24 | 254.47 | NORMAL |
| 120° C. | .94 A | .94 A | 31.81 | 95.43 | 127.24 | Short at S1 |
| 120° C. | .94 A | .94 A | 63.62 | 63.62 | 127.24 | Short at S2 |
| 120° C. | .94 A | .94 A | 95.43 | 31.81 | 127.24 | Short at S3 |

Figure 10:
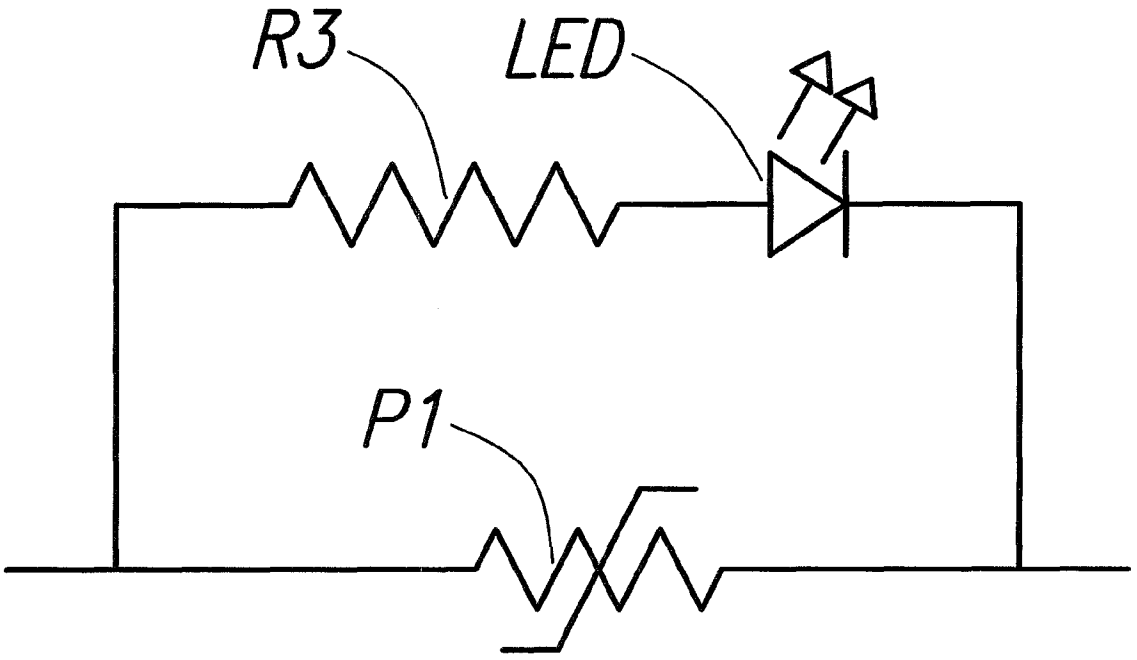
FIG. 10 is a schematic diagram of a fault indicator which may be used in the safety overheat protection circuit (heater wire safety circuit) of the present invention.

It is expected that the fault, or hot spot, will only happen when the heating pad, or electric blanket 50, is used in the abnormal condition and it is bunched or folded and insulated. The user may not be aware that he used the product in a way that was not intended, despite warnings on the label of the product. When a short in the heater wire trips the PPTC device, the voltage across the heater wire is diminished and no apparent heating will be felt by the user. If, however, the pad, or blanket 50, is unplugged or powered off, the PPTC device will reset, and heat will be restored to the product for a short period of time. To alert the user that an abnormal fault condition has caused the safety shutdown, an indicator is preferably used. FIG. 10 shows an automatic fault indicator formed in accordance with the present invention. In the normal heating mode with no wire faults, the current is below the trip current of the PPTC device P1, and the voltage across the PPTC device P1 is less than about 1 volt. A series circuit having a current limiting resistor R3 in series with an LED is placed across the device P1 used in one or more of the safety circuits described previously, and the voltage across the series circuit is not sufficient enough to cause the LED to light. When device P1 goes to a high impedance state, the voltage across the device P1 and the series circuit of resistor R3 and the LED is sufficient to light the LED and indicate to the user that an overheat condition has occurred at the time the product is being improperly used. The LED can shine through a window, such as on a housing of the control unit 56, having a caution symbol such as an exclamation mark ("!"), to indicate to the user that the safety mode has taken over. The automatic fault indicator shown in FIG. 10 may be incorporated in one or more of the circuits of the present invention described herein.

Referring now to FIG. 11, a dual circuit for a heating pad or electric blanket 50 of the present invention is illustrated and will now be described for the wire configuration of the previous example shown in FIG. 9. A heating pad with dual, or multi-circuit, heating elements (wires) has the advantage that a smaller area of overheat comprises a higher percentage of the heater wire element and thus the power is reduced to the heater wires and an overheat is avoided. Two PPTC devices P2 and P3 limit the heating of the wires should a meltdown of the separation layer occur at any place along the lengths of the heater wires. A condition where the corner of the heating pad or electric blanket 50 is folded over, for example, causing a high temperature within the fold, would encompass 50% of the heating circuit when a dual circuit is used. With a single circuit, on the other hand, 25% of the heating area is encompassed. The dual circuit heating pad 50 thus is more responsive to lowering the heat of the high heat zone, preventing in most cases the insulation between the heating conductors from melting. A three-wire control cord 58 having conductors 33, 34 and 35 connects the control unit 56 to the pad 50 and to the four ends of each dual wound heater wires at nodes 25, 26, 27, 28 and 29, 30, 31, 32.

More specifically, and as shown in FIG. 11 of the drawings, the dual circuit includes a first circuit and a second circuit. The first circuit includes a 120 VAC power line 35, which includes a triac T2 connected to the 120 VAC source and connected in series to a PPTC device P3. The device P3 is connected at node 31 preferably located on a printed circuit board 36 or connector, such as described previously with respect to the embodiment shown in FIG. 9, to the first end of a first outer heater conductor 3' (such as shown in FIG. 1A) having a resistance R7 of a first heater wire that extends over at least a portion of the electric blanket or heating pad 50. The second end of the first outer heater conductor 3' is connected to node 30 preferably located on the printed circuit board 36 or connector, and node 30 is connected to node 32 on the printed circuit board 36 or connector, to which is connected the first end of the first inner conductor 1' of the first heater wire (such as shown in FIG. 1A) having a resistance R6. The second end of the first inner conductor 1' having a resistance R6 is connected to node 29 on the printed circuit board 36 or connector of the heating pad or electric blanket 50. Node 29 is connected to the neutral (N) power line 33. The neutral (N) power line 33 is also connected to node 28 on the printed circuit board 36 or connector of the second circuit of the dual circuit of the present invention. Node 28 is connected to the first end of a second inner conductor 1' of a second heater wire (such as shown in FIG. 1A) having a resistance R4 associated therewith. The second end of the second inner conductor 1' having a resistance R4 is connected to node 25 on the printed circuit board 36 or connector of the heating pad or electric blanket 50. Node 25 is connected to node 27 on the printed circuit board 36 or connector, to which is also connected the first end of a second outer heater conductor 3' of the second heater wire (such as shown in FIG. 1A) having a resistance R5. The second end of the second outer conductor 3' having a resistance R5 is connected to node 26 on the printed circuit board 36 or connector of the heating pad or electric blanket 50. Node 26 is connected to a 120 VAC power line 34, which includes a second triac T3 connected to the 120 VAC source, which triac T3 is connected in series with a second PPTC device P2, whose other end is connected to node 26. There is a low melt insulate layer 2' situated in each of the first and second heater wires between the outer conductors 3' having resistances R7 and R5 of the first and second circuits, and the inner conductors 1' having resistances R6 and R4 of the first and second circuits, such as shown in FIG. 1A of the drawings. To facilitate an explanation of the dual circuit of the present invention, possible shorts are illustrated in FIG. 11 by lines S7, S8 and S9 between the outer conductor 3' having resistance R7 and the inner conductor 1' having resistance R6 of the first heater wire of the first heater circuit and located at points 25% (short S9), 50% (short S8) and 75% (short S7) along the length of the first heater wire measured from the beginning of the first heater wire where it is connected to the 120 VAC power line 35. Similarly, shorts in the second heater wire of the second heater circuit are exemplified in FIG. 11 by lines S6, S5 and S4 between the outer conductor 3' having resistance R5 and the inner conductor 1' having resistance R4 of the second heater wire of the second circuit and located at points 25% (short S4), 50% (short S5) and 75% (short S6) along the length of the second heater wire measured from the beginning of the second heater wire where it is connected to the 120 volt AC line 34.

A short due to a meltdown at location S4, S5 or S6 will cause the PPTC device P2 to trip into a high impedance state in the second heater circuit (the lower circuit shown in FIG. 11), and a short at location S7, S8 or S9 will cause the PPTC device P3 to trip into a high impedance state in the first heater circuit (the upper circuit shown in FIG. 11), thus limiting power to either side of the pad or electric blanket 50 in which a fault, such as a short, or overheat condition occurs. The inner and outer heater conductors 1' and 3' respectively having resistances R4 and R5 in the second circuit (the lower circuit shown in FIG. 11) are powered by switching the triac T3 on. The inner and outer heater conductors 1' and 3' respectively having resistances R4 and R5 of the second heating circuit exhibit a positive temperature coefficient of resistance effect that is detected by the control unit 56 as previously described. Similarly, the inner and outer heater conductors 1' and 3' respectively having resistances R6 and R7 in the first heater circuit (shown as the upper circuit in FIG. 11) are powered by switching the triac T2 on, and the heater wire temperature is monitored in a similar manner as in the second (lower) circuit.

Figure 12:
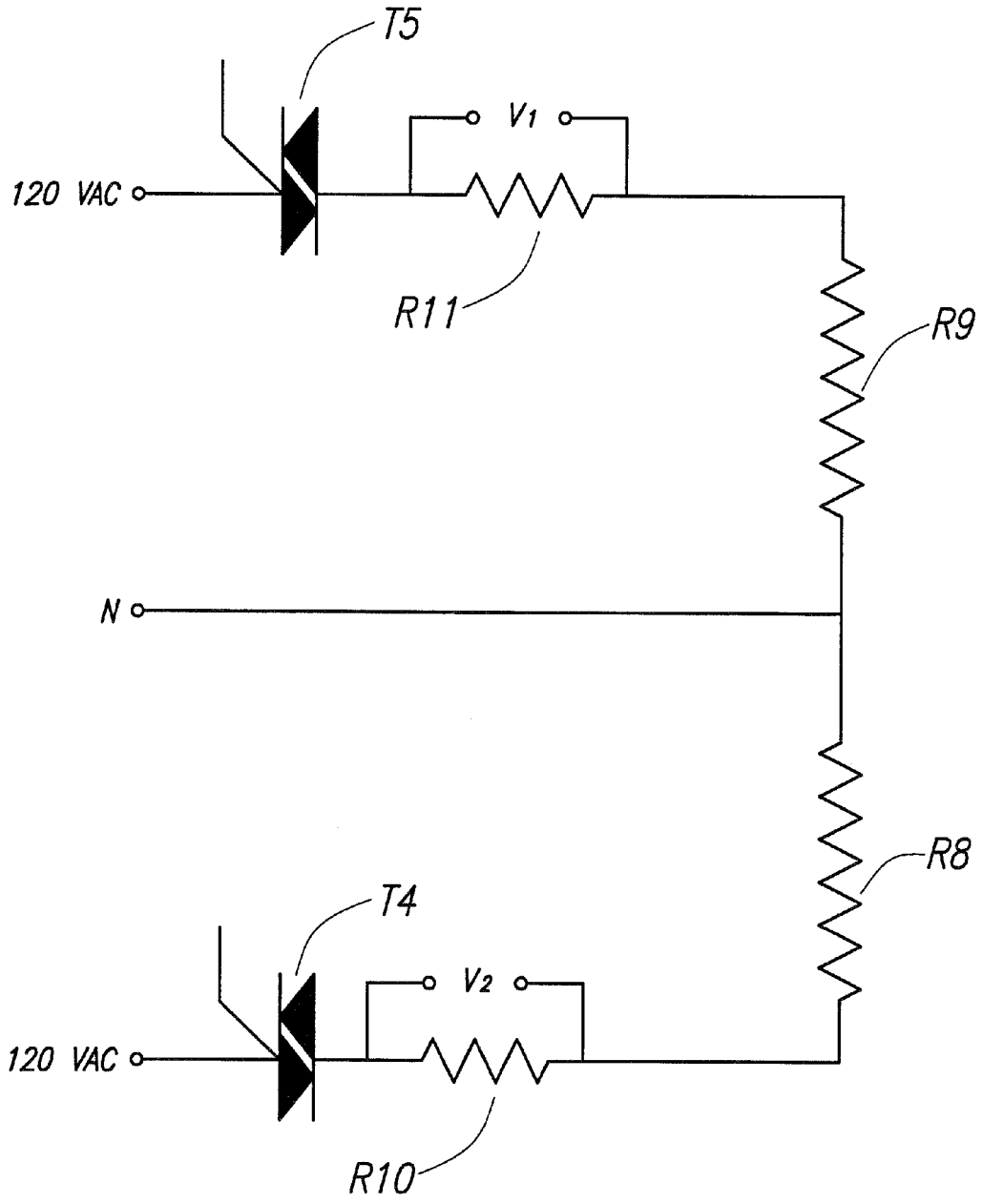
FIG. 12 is a circuit diagram of a simplified dual heater circuit constructed in accordance with another preferred embodiment of the present invention.

The advantages of a dual circuit heating pad 50 formed in accordance with the present invention can be realized for any control method, this being illustrated in a simplified form in FIG. 12. The simplified dual heater circuit includes a first heater conductor having resistance R9 and a second heater conductor having resistance R8. The heater conductors are made of an alloy that exhibits a positive temperature resistance change with temperature. Nickel and Copper are examples of such metals. A resistor R10 is situated in series with the first end of the second heater conductor having resistance R8, and a resistor R11 is situated in series with the first end of the first heater conductor having resistance R9. An end of resistor R11 is connected to a first triac T5, whose other end is connected to the 120 VAC power line. The second end of the first heater conductor having resistance R9 is connected to the neutral (N) power line which is also connected to the second end of the second heater conductor having resistance R8. The other end of resistor R10 is connected to a second triac T4 which, in turn, is connected to the 120 VAC power line The series resistors R10 and R11 are of a low resistance value such as 1 ohm (Ω) to avoid heating the resistors R10 and R11 to any significant degree. Triac T4 controls the current to the series resistor R10 and to the second heater conductor having resistance R8. Similarly, triac T5 controls the current to the series resistor R11 and to the first heater conductor having resistance R9. For the first and second heater conductors respectively having resistances R8 and R9 made of Nickel, the resistance increases by about 0.5% per ° C. If, for example, the resistance of the heater conductors having resistances R8 and R9 is 200Ω at 20° C., and each series resistor R10, R11 is 1Ω, the voltage across each series resistor is 0.597 VAC. At a wire temperature of 90° C., which is an increase of 70° C., the heater conductor having resistance R8 or R9 would be 35% higher, or 270 S2, and the voltage V1 or V2 respectively across the 1Ω series resistor R10 or R11 is 0.442 VAC. In a control circuit in control unit 56, the sensing voltage V1 and V2 can be rectified, and with a comparator, referenced to a known reference resistor at 90° phase to determine the temperature of the heater conductors. This example is illustrated for simplicity, and it should be realized that other dual circuit control methods, including using NTC (negative temperature coefficient) or PTC (positive temperature coefficient) sensing layers within the heater wire, may also be used. It should be further realized that one or more sensing resistors, such as described above, may be used in the other circuits of the present invention described herein and, for example, may be used with or without the PPTC device in the circuits.

Figure 14:
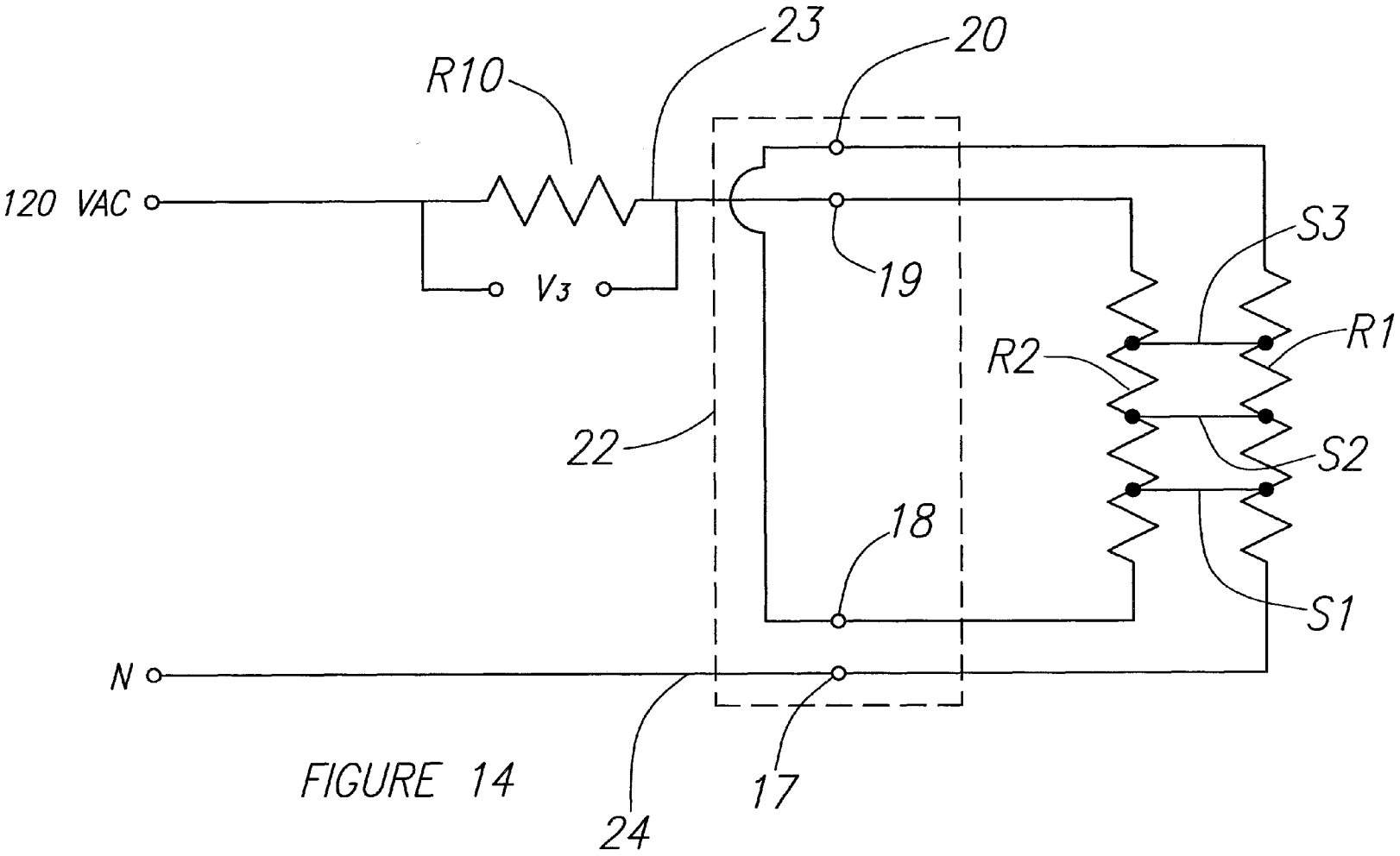
FIG. 14 is a schematic diagram of another version of the heater wire safety circuit (safety overheat protection circuit) shown in FIG. 9, where the fuse F1 of the circuit of FIG. 9 is omitted and the PPTC device P1 of FIG. 9 is replaced by a series sensing resistor R10.
Figure 15:
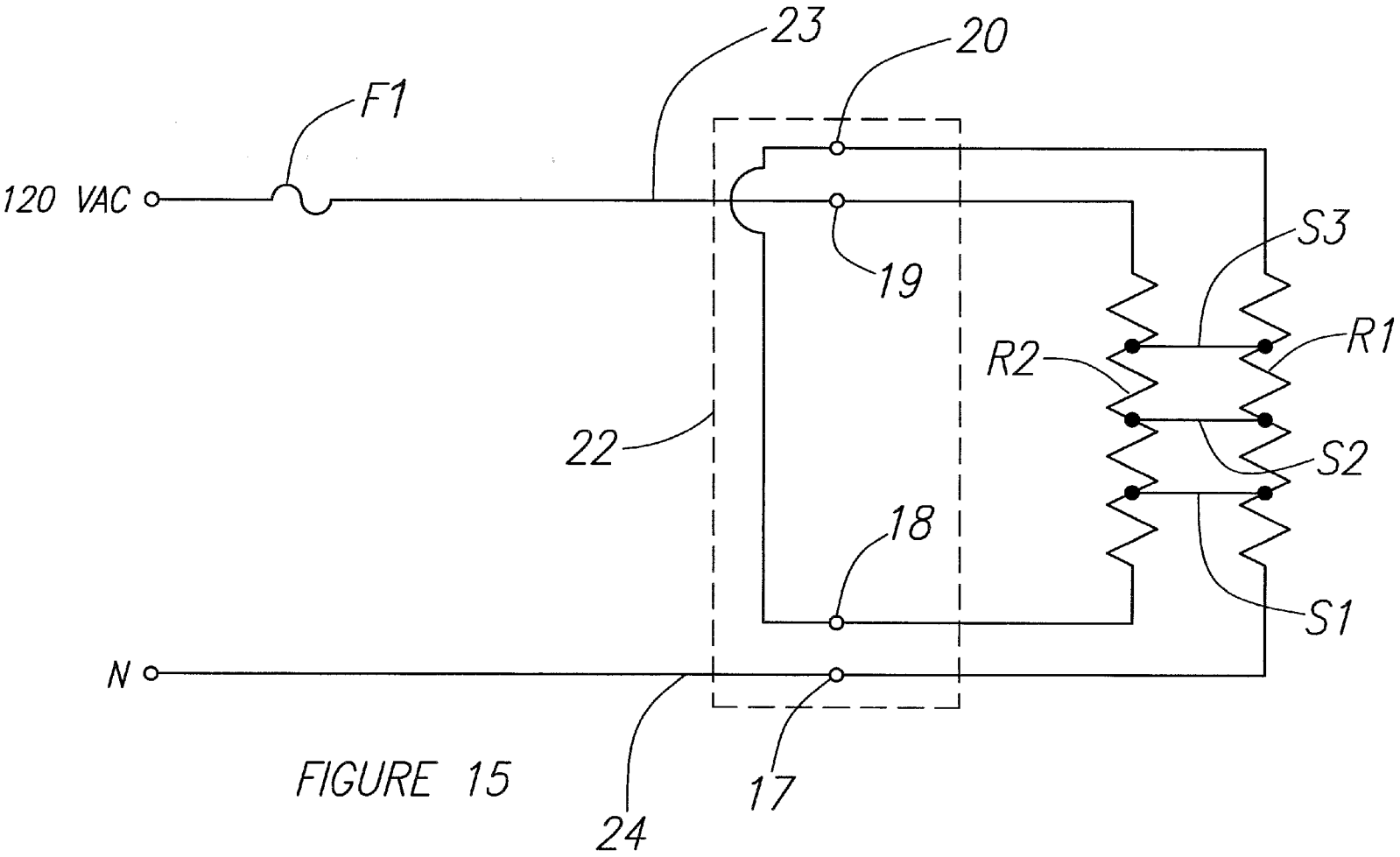
FIG. 15 is a schematic diagram of yet another version of the heater wire safety circuit (safety overheat protection circuit) shown in FIG. 9, where the PPTC device P1 of the circuit of FIG. 9 is omitted.

FIGS. 14 and 15 show variations of the heater wire safety circuit of the present invention shown in FIG. 9. More specifically, in FIG. 14, the fuse F1 in the circuit of FIG. 9 is omitted, and the PPTC device P1 has been replaced with a series connected sensing resistor R10, such as shown in FIG. 12 and described previously. The voltage V3 across resistor R10 (preferably 1Ω) may be monitored in the same manner as described previously with respect to the circuit shown in FIG. 12 to determine if an over current condition exists in the heater wire circuit. FIG. 15 shows a circuit similar to that shown in FIG. 9, but with the PPTC device P1 omitted. Fuse F1 protects the circuit should an overheat condition occur, as described previously with respect to the other embodiments of the present invention employing fuses.

FIGS. 16-19 illustrate several embodiments of a dual heater circuit for use with a heating pad or electric blanket and formed in accordance with the present invention. One of the advantages of the dual heater circuit shown in FIGS. 16-19 is that the duty cycle of the power applied to the heater wire circuits may be controlled based on the resistance of sensor conductors or wires wound about the heater wires in each circuit or based on the resistance of the heater wires themselves, as will be explained in greater detail. It should be noted that the following description of the dual heater wire circuit of the present invention is applicable to a single heater wire circuit for use in a heating pad or electric blanket, where one of the heater wire circuits of the dual circuit embodiment is eliminated. Also, like reference designations and numbers used in the drawings refer to the same or similar components in the circuits.

Figure 16:
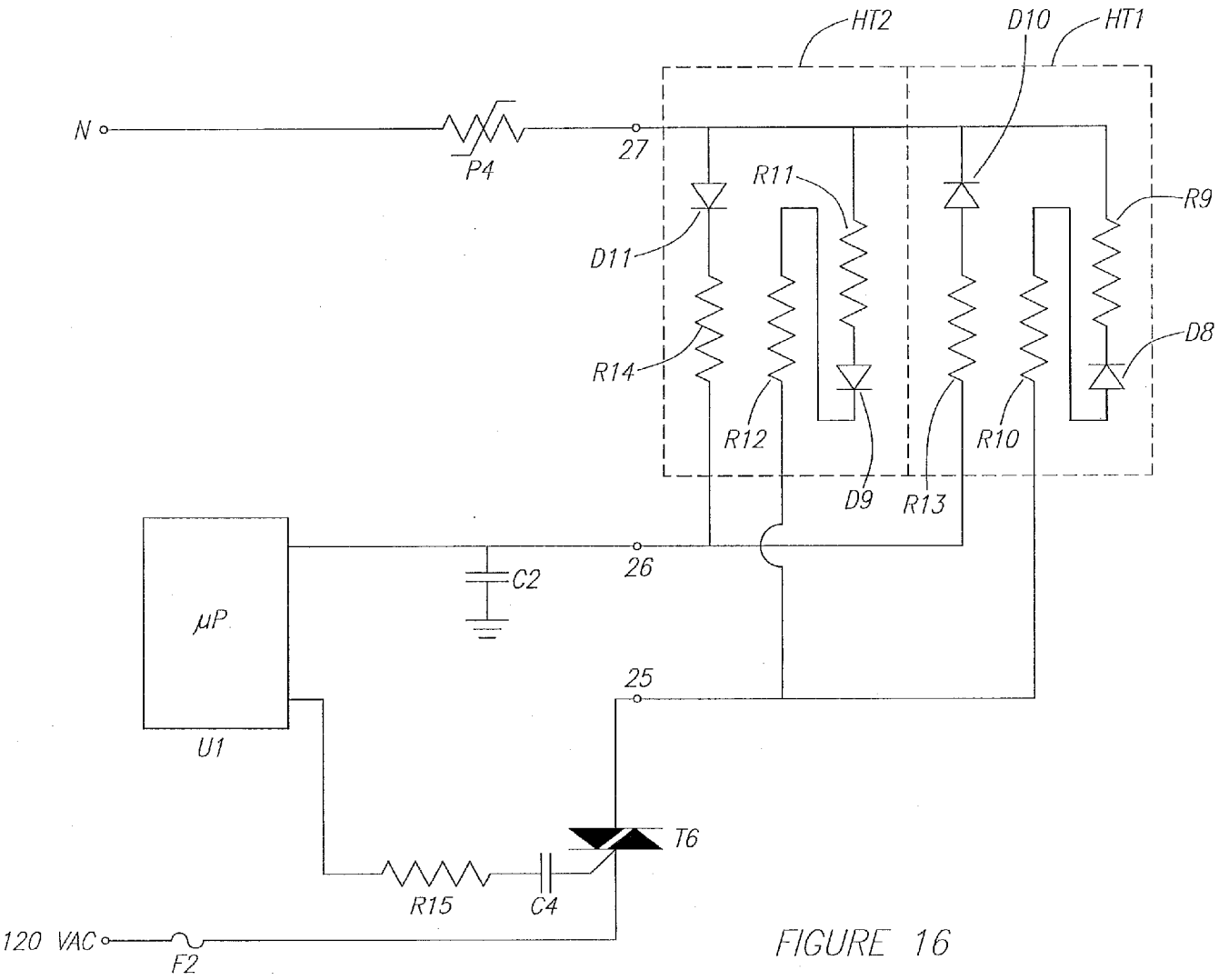
FIG. 16 is a schematic diagram of a dual heater circuit for a heating pad or electric blanket, each heater circuit incorporating a heater wire safety circuit, formed in accordance with the present invention.

Referring initially to FIG. 16 of the drawings, it will be seen that a dual heater wire circuit for use in a heating pad or electric blanket is similar in many respects to the dual circuit shown in FIG. 11 of the drawings and described previously. More specifically, the dual heater wire circuit includes a first heater wire circuit HT1, and a second heater wire circuit HT2. The first heater wire circuit HT1 includes a first heater wire having a first outer heater conductor 3' (such as shown in FIG. 1A) having a resistance R9, and a first inner conductor 1" (such as shown in FIG. 1A) having a resistance R10. The first heater wire extends over at least a portion of the electric blanket or heating pad 50. The first heater wire also includes a diode D8.

More specifically, the first end of the first outer heater conductor 3' of the heater wire of the first heater wire circuit HT1, represented in FIG. 16 by resistor R9, is connected at node or connection point 27 on a printed circuit board 36 or connector to the neutral (N) side of a 120 volt AC power source through a positive temperature coefficient (PPTC) device P4 connected in series between the neutral (N) line of the power source and connection point 27. The second end of the first outer heater conductor 3' of the heater wire of the first heater circuit HT1 is connected to the cathode of diode D8, whose anode is connected to the first end of the first inner conductor 1' of the heater wire of the first heater wire circuit HT1, the first inner conductor being represented in FIG. 16 by resistor R10. The second end of the first inner conductor 1' is connected to node or connection point 25 of a printed circuit board 36 or connector which, in turn, is connected to one end of a triac T6, controlling part of a control circuit for controlling power provided to the first and second heater wire circuits HT1, HT2.

Preferably, the first and second ends of the outer conductor 3' are respectively located on the same axial sides of the first and second ends of the inner conductor 1', as shown in FIG. 1A. Stated another way, the first end of the outer conductor 3' of the first heater wire is situated axially closer to the first end of the inner conductor 1' of the first heater wire than to the second end of the inner conductor 1' of the first heater wire, and the second end of the outer conductor 3' of the first heater wire is situated axially closer to the second end of the inner conductor 1' of the first heater wire than to the first end of the inner conductor 1' of the first heater wire. Alternatively, the opposite may occur, where the first end of the outer conductor 3' of the first heater wire is situated axially closer to the second end of the inner conductor 1' of the first heater wire than to the first end of the inner conductor 1' of the first heater wire, and the second end of the outer conductor 3' of the first heater wire is situated axially closer to the first end of the inner conductor 1' of the first heater wire than to the second end of the inner conductor 1' of the first heater wire.

The heater wire of the first heater wire circuit also includes a first sensor conductor or wire, being represented in FIG. 16 by resistor R13, which is counterwound on the outside of the first outer heater conductor 3'. Preferably, the first sensor conductor R13 is of a positive temperature coefficient type having a characteristic in which its electrical resistance increases with increasing temperature.

The first end of the first sensor conductor R13 is connected to the anode of a diode D10, whose cathode is connected to the first end of the first outer heater conductor 3', represented by resistor R9, of the first heater wire circuit HT1 and to node or connection point 27 on the printed circuit board 36 or connector. The second end of the first sensor conductor R13 is provided to node or connection point 26 of the printed circuit board 36 or connector, and to one end of a capacitor C2, forming part of the control circuit for the heating pad or electric blanket, the other end of which is connected to ground. Node or connection point 26 is also connected to a signal input on a microprocessor U1 forming part of the control circuit for the heating pad or electric blanket.

The second heater wire circuit HT2 has a similar configuration and structure to that of the first heater wire circuit HT1, except that the polarity of the diodes used therein are reversed from that of the diodes D8, D10 of the first heater wire circuit HT1.

More specifically, the heater wire of the second heater wire circuit HT2 includes a second outer heater conductor 3' (such as shown in FIG. 1A) having a resistance R11, and a second inner conductor 1' having a resistance R12. The heater wire of the second heater wire circuit HT2 is disposed to extend over at least another portion of the electric blanket or heating pad.

Even more specifically, the first end of the second outer heater conductor 3', denoted in FIG. 16 by resistor R11, is connected to node or connection point 27 on the printed circuit board 36 or connector and, thus, to the neutral (N) line of the 120 volt AC power source through series-interconnected PPTC device P4, and to the cathode of diode D10 and the first end of the first outer heater conductor 3', denoted by resistor R9, of the first heater wire circuit HT1. The second end of the second outer heater conductor 3', denoted by resistor R11 in FIG. 16, is connected to the anode of diode D9, whose cathode is connected to the first end of the second inner conductor 1', denoted in FIG. 16 by resistor R12. The second end of the second inner conductor 1' is connected to node or connection point 25 on the printed circuit board 36 or connector and, thus, also to one end of the triac T6 and the second end of the first inner conductor 1', denoted by resistor R10 in FIG. 16, of the first heater wire circuit HT1.

Like the first heater wire, the first and second ends of the outer conductor 3' of the second heater wire are preferably respectively located on the same axial sides as the first and second ends of the inner conductor 1" of the second heater wire, as shown in FIG. 1A. Stated another way, the first end of the outer conductor 3' of the second heater wire is situated axially closer to the first end of the inner conductor 1" of the second heater wire than to the second end of the inner conductor 1' of the second heater wire, and the second end of the outer conductor 3' of the second heater wire is situated axially closer to the second end of the inner conductor 1' of the second heater wire than to the first end of the inner conductor 1' of the second heater wire. Alternatively, the opposite may occur, where the first end of the outer conductor 3' of the second heater wire is situated axially closer to the second end of the inner conductor 1' of the second heater wire than to the first end of the inner conductor 1' of the second heater wire, and the second end of the outer conductor 3' of the second heater wire is situated axially closer to the first end of the inner conductor 1' of the second heater wire than to the second end of the inner conductor 1' of the second heater wire.

The heater wire of the second heater wire circuit HT2 also includes a sensor conductor, denoted in FIG. 16 by resistor R14, which is counterwound on the outside of the second outer conductor 3' of the heater wire forming part of the heater wire circuit HT2. Like the first sensor conductor R13 of the first heater wire circuit HT1, the second sensor conductor R14 of the second heater wire circuit HT2 is of the positive temperature coefficient type having the characteristic of an electrical resistance which increases with increasing temperature.

The first end of the second sensor conductor R14 is connected to the cathode of a diode D11, forming part of the second heater wire circuit HT2, whose anode is connected to the node or connection point 27 on the printed circuit board 36 or connector. Thus, the anode of diode D11 of the second heater wire circuit HT2 is also connected to the first end of the second outer heater conductor 3', denoted in FIG. 16 by resistor R11, of the heater wire of the second heater wire circuit HT2, and to the cathode of diode D10 and the first end of the first outer heater conductor 3', denoted by resistor R9 in FIG. 16, of the first heater wire circuit HT1.

The second end of the second sensor conductor, denoted by resistor R14, of the second heater wire circuit HT2 is connected to node or connection point 26 on the printed circuit board 36 or connector, and thus to capacitor C2 and the signal input of the microprocessor U1.

In summary, the heater wires of the first and second heater wire circuits HT1, HT2, denoted by resistors R9, R10, R11 and R12, are connected in opposition similar to the configuration of the dual heater circuit shown in FIG. 11, but with the addition of diodes D8 and D9. Furthermore, the additional sensor conductors are connected in series with diodes D10 and D11. The diodes for both the heater wires and sensor conductors are arranged in opposite directions so that the heater wire circuit HT1 only operates in the positive half cycle of the AC power from the power source, and the heater wire circuit HT2 only operates in the negative half cycle of the AC power provided by the power source.

The resistance of the first sensor conductor R13 is indicative of the temperature of the heater wire of the first heater wire circuit HT1 and varies in response to changes in temperature of the first heater wire. Similarly, the resistance of the second sensor conductor R14 is indicative of the temperature of the heater wire of the second heater wire circuit HT2 and varies in response to changes in temperature of the second heater wire.

As mentioned previously, in the embodiment of the dual heater wire circuit shown in FIG. 16, each sensor conductor R13, R14 forms part of a voltage divider circuit with the phase shifter capacitor C2. As also mentioned previously, the junction between the capacitor C2 and each of the first and second sensor conductors R13, R14 is connected to a signal input of the microprocessor U1 in order to measure the phase shift that varies relative to the temperature of each heater wire circuit HT1, HT2. More specifically, the phase shift associated with the first heater wire circuit HT1 is measured in the positive half cycle of the power provided to the heating pad or electric blanket, and the phase shift associated with the second heater wire circuit HT2 is measured in the negative half cycle of the power supplied to the heating pad or electric blanket.

Both heater wire circuits HT1, HT2 are controlled at substantially the same predetermined temperature. More specifically, the triac T6 is trigged by a signal outputted by the microprocessor U1 through a resistor R15 and a capacitor C4 connected in series to resistor R15, the other end of capacitor C4 being connected to the control or trigger input on the triac T6, and the other end of resistor R15 being connected to the trigger output port of microprocessor U1. Thus, the microprocessor U1 controls the power provided to each of the heater wire circuits HT1, HT2 separately by sending a trigger pulse to the triac T6 at the power zero crossings, that is, at zero degrees and 180° phase angle, independently. A reference phase signal is provided to the microprocessor U1 from the power source connected to the heating pad or electric blanket which is indicative of the power input zero crossings (not shown).

A low melt polymetric layer 2 is situated within the heater wire of each of the first and second heater wire circuits HT1, HT2, that is, between the first outer heater conductor 3', denoted by resistor R9, and the first inner heater conductor 1', denoted by resistor R10, of the first heater wire circuit HT1, and between the second outer heater conductor 3', denoted by resistor R11, and the second inner conductor 1', denoted by resistor R12, of the heater wire of the second heater wire circuit HT2, as is also shown in FIGS. 1 and 1A of the drawings. This low melt layer 2 has a known melt temperature, such as 130° C. If the heater wire in the first or second heater wire circuits HT1, HT2 of the heating pad or electric blanket overheats due to an abnormal use or bunching condition of the pad or blanket, the inner and outer conductors 1', 3' of the heater wire in either heater wire circuit HT1, HT2 will come into electrical contact with each other when the polymetric layer 2 melts at its melt temperature, and the resistance of the heater wire decreases and also shunts the diode, D8 or D9, in the heater wire circuit, HT1 or HT2, which causes a higher current to flow through the heater wire circuit, HT1 or HT2, as the circuit now conducts on both the positive and negative cycles of the power provided to the heating pad or the electric blanket, since the respective diode, D8 or D9, is shunted. This higher current, in turn, causes the PPTC device P4 to open and/or opens a fuse F2 situated in line between the 120 volt AC hot line and the other end of the triac T6. Opening the fuse F2 or the PPTC P4 effectively removes power from the entire heating pad or electric blanket.

In the dual heater wire circuit shown in FIG. 16, the control for the heating pad or electric blanket is attached by three control conductors to the nodes or connection points 25, 26 and 27.

Thus, the circuit shown in FIG. 16 controls the duty cycle of the power provided to the heating pad or electric blanket on the basis of the phase shift detected by the microprocessor U1 at the juncture between capacitor C2 and the second end of the first and second sensor wires R13, R14 wound about the heater wires of the first and second heater wire circuits HT1, HT2. Since the resistance of the sensor wires R13, R14 varies with temperature along the length of the heater wires in each of heater wire circuits HT1 and HT2, the resistance of such sensor conductors, in combination with capacitor C2, will affect the phase of the signal provided to the microprocessor at node or connection point 26. The microprocessor U1, in response to the detected phase of this input signal, will control the duty cycle of the power provided to the heating pad or electric blanket with shorter or longer triggering pulses provided to the triac T6. Thus, the temperature of the heating pad or electric blanket may be detected by this circuit, and may be controlled. However, if an overheat condition occurs in the heating pad or electric blanket, the circuit of the present invention will go into a failsafe mode when the polymetric layer 2 within the heater wire melts, causing the PPTC device 4 or fuse F2 to open, removing power entirely from the heating pad or electric blanket.

Figure 17:
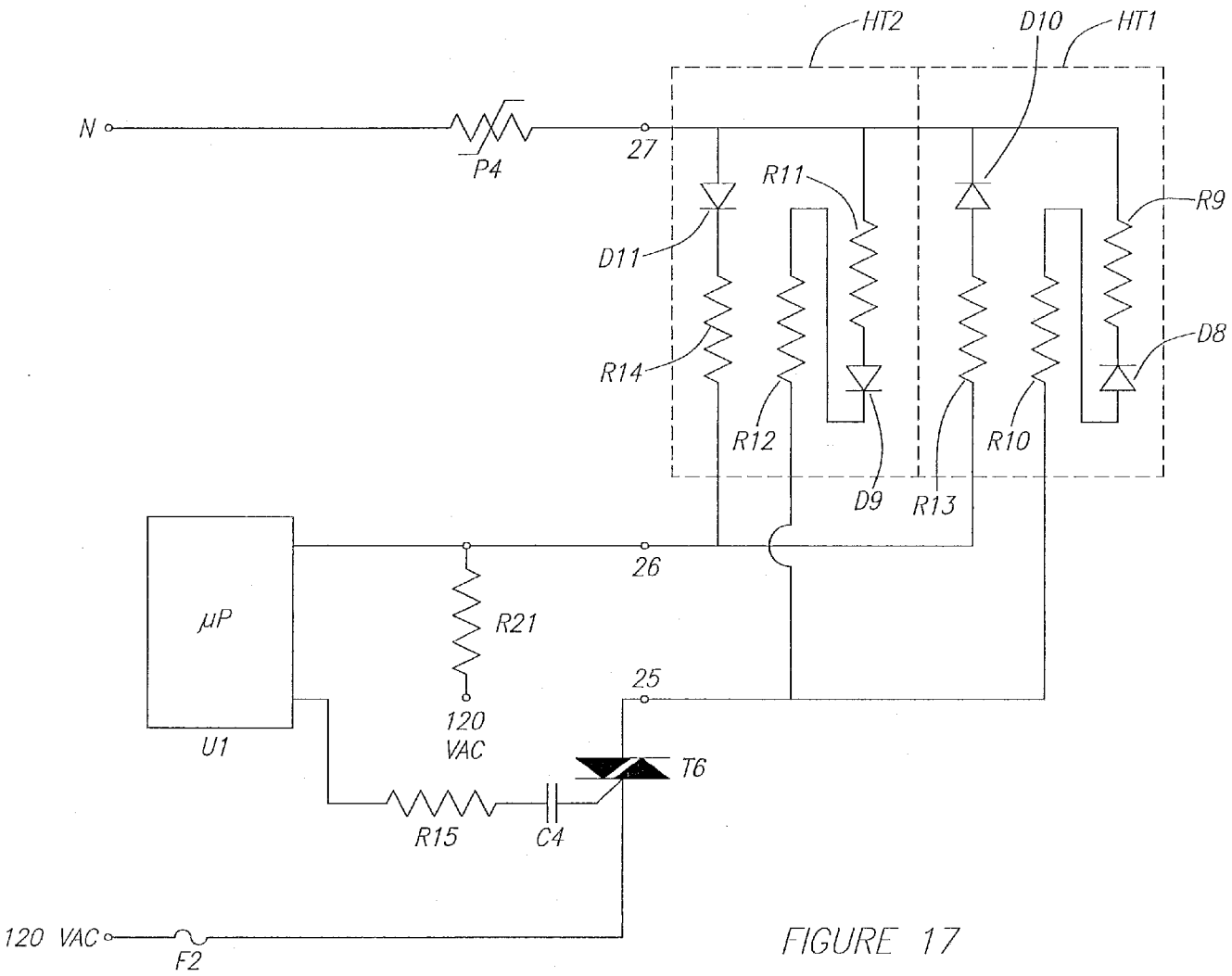
FIG. 17 is a schematic diagram of an alternative form of the dual heater circuit shown in FIG. 16 and formed in accordance with the present invention.

The circuit of the present invention shown in FIG. 17 is similar in many respects to the circuit shown in FIG. 16 and includes substantially the same structure. However, the dual heater wire circuit of FIG. 17 includes resistor R21 in place of capacitor C2. More specifically, one end of resistor R21 is connected to node or connection point 26 and to the second end of each of the first and second sensor conductors R13, R14 and to the input of the microprocessor U1. The other end of resistor R21 is connected to the hot line of the 120 volt AC power source. Thus, resistor R21 forms a voltage divider with the first sensor conductor R13 and the second sensor conductor R14 respectively of the first and second heater wire circuits HT1, HT2. The resistance of each sensor conductor R13, R14 varies with the temperature of the heater wire about which it is wrapped and, thus, the voltage at node or connection point 26 at the juncture between resistor R21 and the sensor conductors R13 and R14 provided to the input of the microprocessor U1 will vary with the temperature of the heater wire in the first and second heater wire circuits HT1, HT2. In summary, with the circuit of FIG. 17, the heater wire temperature of the heating pad or electric blanket is determined by voltage instead of by phase shift.

A lower cost version of the dual heater wire circuit shown in FIG. 16 (or, for that matter, shown in FIG. 17) may be constructed to have only a two-conductor connection to the heating pad or electric blanket. Such a circuit, formed in accordance with the present invention, is shown in FIG. 18 of the drawings.

Figure 18:
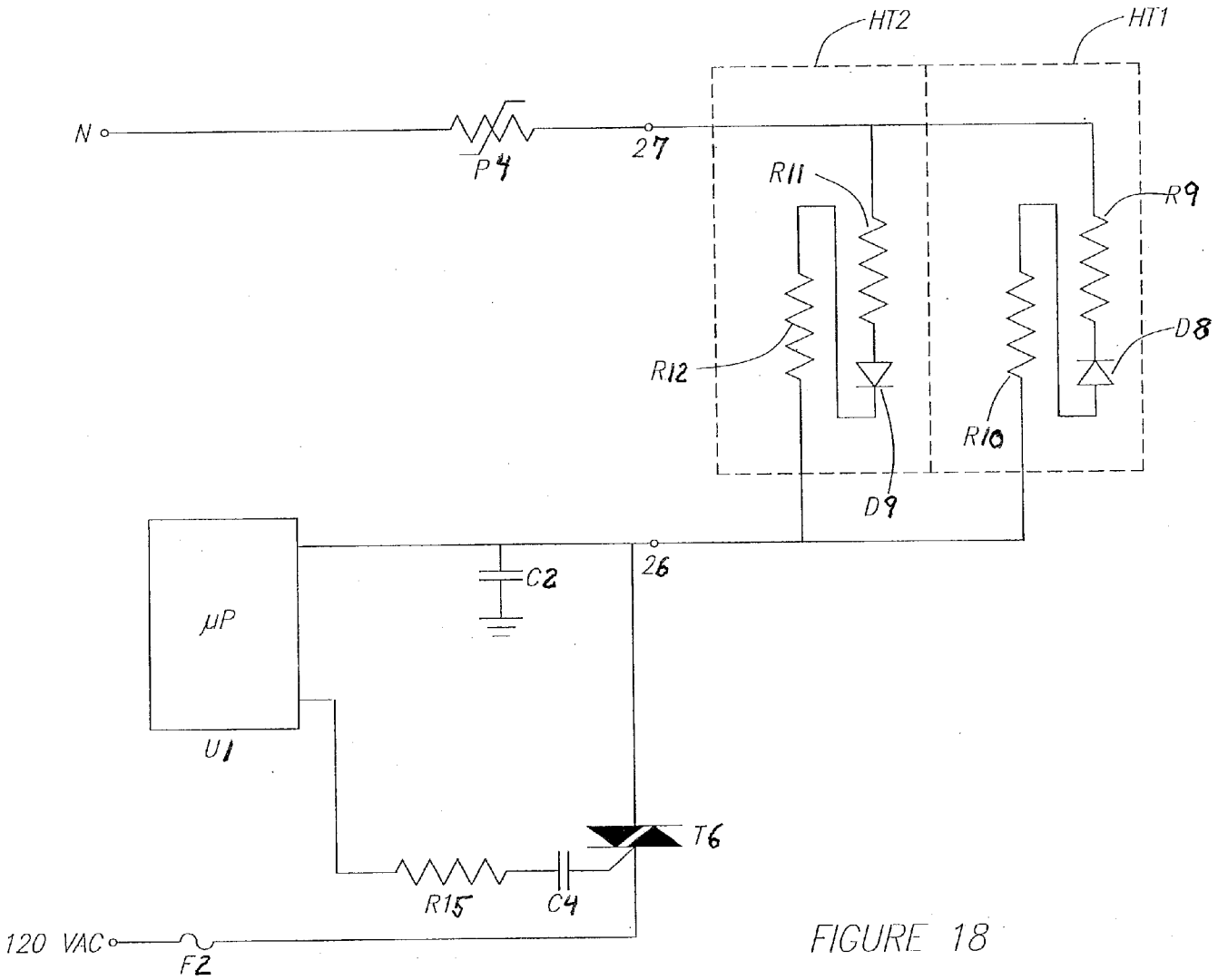
FIG. 18 is a schematic diagram of yet another alternative embodiment of the dual heater circuit shown in FIG. 16.

In the circuit of FIG. 18, the heater wire of the first heater wire circuit HT1 is connected in the same manner as the heater wire of the first wire circuit HT1 shown in FIG. 16, but without the first sensing conductor R13 and diode D10. Similarly, the heater wire of the second heater wire circuit HT2 is connected in the same manner as the heater wire of the second heater wire circuit HT2 shown in FIG. 16, but without the second sensing conductor R14 and the associated diode D11.

In the embodiment shown in FIG. 18 of the drawings, either or both of the outer and inner conductor 3', 1', denoted respectively in FIG. 18 by resistors R9 and R10, of the heater wire of the first heater wire circuit HT1 themselves are made with an alloy that exhibits a positive temperature coefficient of resistance, i.e., the resistances R9 and R10 increase with an increase in temperature. Similarly, either or both of the outer and inner conductors 3', 1', denoted respectively by resistors R11 and R12 in FIG. 18, of the heater wire of the second heater wire circuit HT2 are made with an alloy that exhibits a positive temperature coefficient of resistance and, thus, the resistances R11 and R12 vary with temperature. Diode D8, situated between the ends of the outer and inner conductors, R9 and R10, of the heater wire of the first heater wire circuit HT1 controls the direction of current for both the heating and detecting functions, where the heater wire circuit HT1 is both powered and measured in the positive half cycle of the power signal provided to the heating pad or electric blanket. Similarly, diode D9, situated between the ends of the outer and inner conductors 3', 1', denoted by resistors R11 and R12, of the heater wire in the second heater wire circuit HT2 controls the direction of current for both the heating and detecting functions of the second heating wire circuit HT2, the second heater wire circuit HT2 being both powered and measured in the negative half cycle of the power provided to the heating pad or electric blanket.

In the circuit shown in FIG. 18, the first end of each of the outer conductors 3', denoted by resistors R9 and R11, of the heater wires of the first and second heater wire circuits HT1, HT2, is connected to node or connection point 27 of the printed circuit board 36 or connector, which in turn is connected to the neutral (N) line of the 120 volt AC power source through PPTC device P4, as is the case with the circuit of the present invention shown in FIG. 16 and described previously. The orientation and connection to the diodes D8, D9 between the outer and inner conductors 3', 1' of the heater wires in the first and second heater wire circuits HT1, HT2 remain the same in this embodiment as described previously and shown in FIG. 16.

However, in this alternative embodiment shown in FIG. 18, the second end of each of the first and second inner conductors 1', denoted by resistors R10 and R12, of the heater wires of the first and second heater wire circuits HT1, HT2 is connected to node or connection point 26 on the printed circuit board or connector and, in turn, to one end of capacitor C2 (whose other end is connected to ground) and to one end of triac T6. As in the embodiment shown in FIG. 16, this alternative embodiment shown in FIG. 18 also has the first end of capacitor C2 and node 26 connected to the signal input of the microprocessor U1, the output port of microprocessor of U1 is connected to the trigger input of triac T6 through series interconnected resistor R15 and capacitor C4, and the other end of triac T6 is connected to the hot side of the 120 volt AC power source through fuse F2.

As with the previously described circuit shown in FIG. 16, in the particular embodiment shown in FIG. 18, the heater wires of the first and second heater wire circuits HT1, HT2 form part of a divider circuit with phase shift capacitor C2, and the juncture between the heater wires and capacitor C2 exhibits a phase shift that varies based on the temperature of the heater wire of heater wire circuit HT1, when measured by microprocessor U1 in the positive half cycle of the power supplied to the heating pad or electric blanket, and varies relative to the temperature of the heater wire in heater wire circuit HT2 when measured by the microprocessor U1 in the negative half cycle of the power supplied to the heating pad or electric blanket. The triac T6 is triggered by an output signal from the microprocessor U1 through the current limiting resistor R16 and capacitor C5 to switch power to the heater wire of heater wire circuit HT1 at input phase zero when the temperature is below the set point (as described previously with respect to the circuit shown in FIG. 16), i.e., the set temperature of the heater wire of the first heater wire circuit HT1, and at the input phase of 180° when the temperature of the heater wire of the second heater wire circuit HT2 is below its set point. Preferably, the predetermined set point temperature for each heater wire circuit HT1, HT2 is substantially the same.

With the circuit shown in FIG. 18, the microprocessor U1 periodically interrupts the power supply to the heating pad or electric blanket by providing no trigger signal to the triac T6, so that the phase or phase shift at the juncture between the heater wires and capacitor C2, at node or connection point 26, provided to the input port of the microprocessor U1 may be detected by the microprocessor.

In a similar manner to the circuit shown in FIGS. 16 and 17, the heater wire in each of the first and second heater wire circuits HT1, HT2 includes a low melt polymetric layer 2 situated between the inner and outer conductors 1', 3' and having a known melt temperature. In this way, should an over temperature condition occur in the heater wires of either heater wire circuit HT1, HT2, of the heating pad or electric blanket, the polymetric layer 2 will melt, shorting the outer conductor 3' to the inner conductor 1' in either circuit HT1, HT2, resulting in a high current that will either trip the PPTC device P4 or open the fuse F2, thereby completely removing power from the heating pad or electric blanket. Of course, it should be realized that the circuit of FIG. 18 may be modified in the manner shown in FIG. 17, to include a resistor, such as resistor 21 shown in FIG. 17, so that the voltage divider circuit defined by the combination of this resistor and the heater wires will provide a signal to microprocessor U1 that varies in magnitude, as opposed to phase, based on changes in the temperature of the heater wires in the heater wire circuits HT1, HT2.

Figure 19:
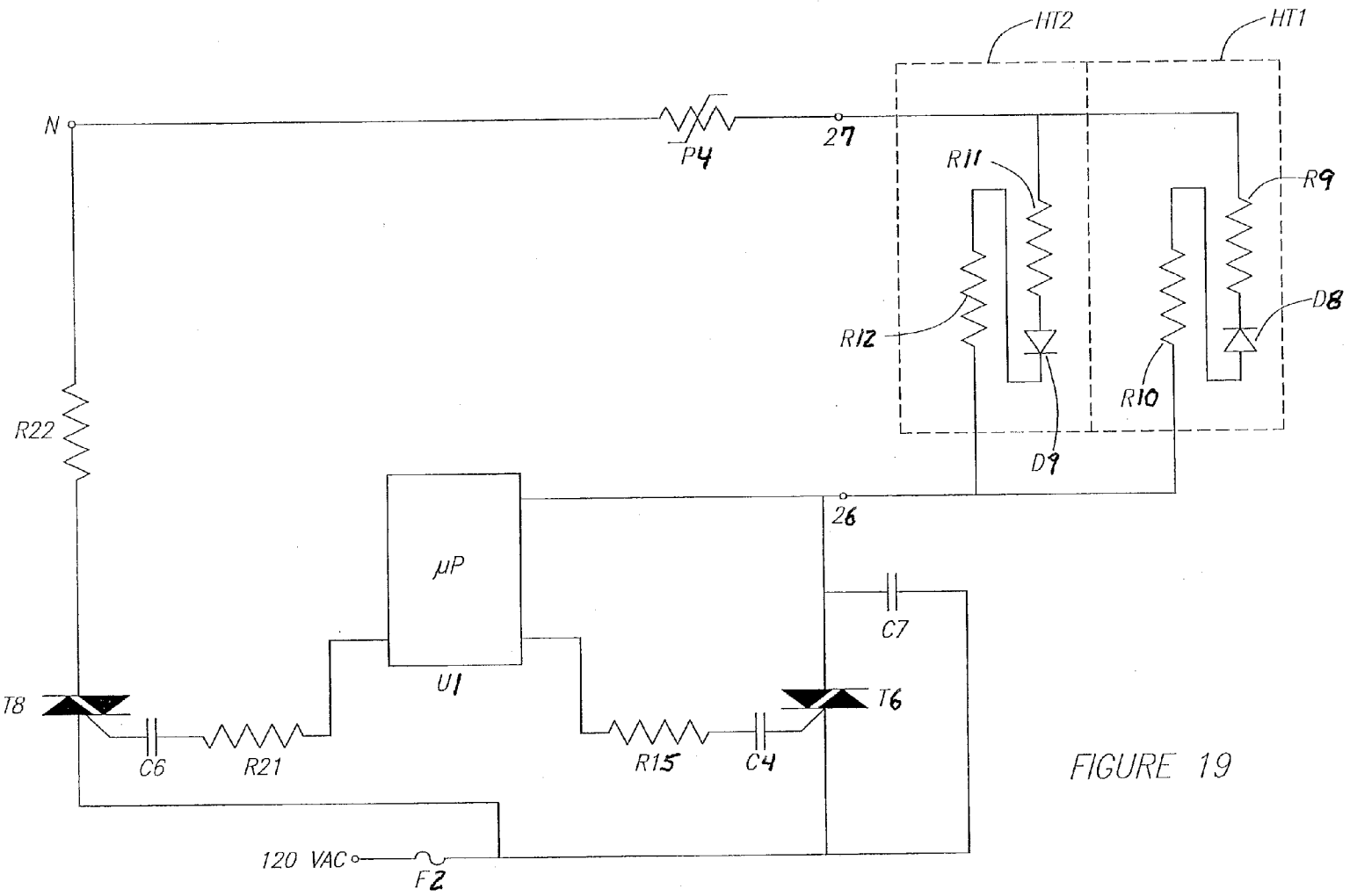
FIG. 19 is a schematic diagram of a further embodiment of the dual heater circuit of the present invention shown in FIG. 16.

FIG. 19 illustrates an alternative version of the dual heater wire circuit shown in FIG. 18 and formed in accordance with the present invention. Each heater wire of the first and second heater wire circuits HT1, HT2 in the circuit of FIG. 19 has the same structure and is arranged in the same manner as the heater wires of the first and second heater wire circuits HT1, HT2 shown in FIG. 18 and described previously. Also, the connection of the heater wires to node or connection point 26 and the signal input of the microprocessor U1, and to the neutral (N) side of the power source through PPTC device P4, remain the same as they were in the circuit shown in FIG. 18 and described previously.

In the circuit shown in FIG. 19, a second triac T8 is used to operate a crowbar circuit to open the fuse F2. The crowbar circuit may be used when it is determined that the main triac T6 is shorted. In this crowbar circuit, triac T8 is triggered by a signal provided on a second output of the microprocessor U1 through resistor R21 and capacitor C6 connected in series with resistor R21, the signal being provided to the trigger input of triac T8. One side of triac T8 is provided to the neutral (N) side of the 120 volt AC power source through resistor R22, and the other end of triac T8 is connected to one side of the fuse F2, whose other side is connected to the hot side of the 120 volt AC power line. Triac T6, the primary triac which provides power to the heater wires of the first and second heater wire circuits HT1, HT2 in the heating pad or electric blanket, is configured in the same manner as shown in FIG. 18 and described previously, except that a capacitor C7 is connected in parallel across the terminals of the triac T6, the capacitor C7 functioning in a similar manner as the capacitor C2 in the circuit of FIG. 18 to form a voltage divider circuit with the heater wires to provide a signal to microprocessor U1 that varies in phase with changes in the temperature of the heater wires in heater wire circuits HT1, HT2. More specifically, capacitor C7 forms a voltage divider circuit with the heater wires of the first and second heater wire circuits HT1, HT2 and provides a signal that may shift in phase at node or connection point 26 connected to the input of microprocessor U1, which is indicative of the temperature of the heater wires in the first and second heater wire circuits HT1, HT2, based on the resistance of the heater wires which vary with temperature.

The resistance of resistor R22 is chosen to cause the fuse F2 to open when the primary triac T6 fails. Triac T8 in the crowbar circuit is triggered by the microprocessor U1 through the series combination of resistor R21 and capacitor C6.

In each of the above circuit configurations shown in FIGS. 16-19, it should be realized that the heater circuit triac T6 may be triggered by the microprocessor U1 to switch power to the heater wires of the heater wire circuits HT1, HT2 in a limited duty cycle, such as one-third duty cycle, rather than a one-half duty cycle, so that, if the triac T6 shorts, the power provided to the heater wires of the first and second heater wires circuits HT1, HT2 will be at a 100% duty cycle and will cause a high current to open the PPTC device P4 or the fuse F2, completely removing power to the heating pad or electric blanket. Thus, such a situation does not rely on the reliability of the microprocessor U1.

Additionally, and as described previously, the dual heater circuits shown in FIGS. 16-19 may be modified to operate with only one heater wire circuit, HT1 or HT2, having the structure shown in FIGS. 16-19. With such a single heater wire circuit, it may be desirable to operate the circuit in both the positive and negative half cycles of the power signal provided to the heating pad or electrical blanket. In such a situation, the diode D8 or D9 of the selected heating wire may be omitted, and the diode D10 or D11 of the selected sensor conductor may also be omitted. Such a circuit can still provide a phase-varying or magnitude-varying signal to the microprocessor U1 which, in turn, will provide trigger signal to the triac T6 to varying the duty cycle of the power signal provided to the heating pad or electric blanket based on the temperature of the heater wire used in the circuit, HT1 or HT2.

By way of illustration, schematics have been presented for both single and dual temperature control circuits, and also for both full, half and intermediate cycle power, to describe the operation of the present invention. The particular materials described are for example, and the invention is not limited to the particular materials other than their properties relative to the intent of the function of the circuit.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A heater wire safety circuit for use with an electric blanket or heating pad, which comprises:

a first heater circuit and a second heater circuit, the first heater circuit including:

1) a first heater wire, the first heater wire having:

a) a first conductor portion;

b) a second conductor portion disposed in proximity to the first conductor portion over at least a portion of the length thereof, the first conductor portion having a first end and a second end situated opposite the first end thereof, the second conductor portion having a first end and a second end situated opposite the first end thereof;

c) a low melt insulate layer situated between the first conductor portion and the second conductor portion along at least a portion of the length of the first conductor portion, the first end of the first conductor portion being in electrical communication with a source of alternating electrical power; and d) a first diode, the first diode having an anode and a cathode, the cathode of the first diode being connected to the second end of the first conductor portion of the first heater wire, the anode of the first diode being connected to the first end of the second conductor portion of the first heater wire;

2) a first temperature sensor conductor, the first temperature sensor conductor being disposed in proximity to one of the first conductor portion and the second conductor portion of the first heater wire, the first temperature sensor conductor having a resistance which varies in response to the temperature of at least one of the first conductor portion and the second conductor portion of the first heater wire, the first temperature sensor conductor having a first end and a second end situated opposite the first end thereof; and 3) a second diode, the second diode having an anode and a cathode, the cathode of the second diode being in electrical communication with the source of electrical power and the first end of the first conductor portion of the first heater wire, the anode of the second diode being connected to the first end of the first temperature sensor conductor;

wherein the second heater circuit includes:

1) a second heater wire, the second heater wire having:

a) a first conductor portion;

b) a second conductor portion disposed in proximity to the first conductor portion over at least a portion of the length thereof, the first conductor portion having a first end and a second end situated opposite the first end thereof, the second conductor portion having a first end and a second end situated opposite the first end thereof;

c) a low melt insulate layer situated between the first conductor portion and the second conductor portion along at least a portion of the length of the first conductor portion, the first end of the first conductor portion being in electrical communication with the source of alternating electrical power; and d) a third diode, the third diode having an anode and a cathode, the anode of the third diode being connected to the second end of the first conductor portion of the second heater wire, the cathode of the third diode being connected to the first end of the second conductor portion of the second heater wire;

2) a second temperature sensor conductor, the second temperature sensor conductor being disposed in proximity to one of the first conductor portion and the second conductor portion of the second heater wire, the second temperature sensor conductor having a resistance which varies in response to the temperature of at least one of the first conductor portion and the second conductor portion of the second heater wire, the second temperature sensor conductor having a first end and a second end situated opposite the first end thereof; and 3) a fourth diode, the fourth diode having an anode and a cathode, the anode of the fourth diode being in electrical communication with the source of electrical power and the first end of the first conductor portion of the second heater wire, the cathode of the fourth diode being connected to the first end of the second temperature sensor conductor;

and wherein the heater wire safety circuit further comprises:

a capacitor, the capacitor having a first end and a second end, the first end of the capacitor being in electrical communication with the second end of the first temperature sensor conductor of the first heater circuit and being in electrical communication with the second end of the second temperature sensor conductor of the second heater circuit, the capacitor defining with the first temperature sensor conductor and the second temperature sensor conductor a voltage divider circuit, the voltage divider circuit generating a signal thereon which varies in phase angle in response to variations in the resistance of at least one of the first temperature sensor conductor and the second temperature sensor conductor;

a microprocessor, the microprocessor having a signal input, the signal input being in electrical communication with the voltage divider circuit and being provided with the phase-varying signal generated by the voltage divider circuit, the microprocessor generating a trigger signal in response to the phase-varying signal provided on the signal input of the microprocessor; and a switching device, the switching device having a trigger signal input, a power signal input and a power signal output, the power signal output of the switching device being in electrical communication with the second end of the second conductor portion of the first heater wire of the first heater circuit and being in electrical communication with the second end of the second conductor portion of the second heater wire of the second heater circuit, the power signal input of the switching device being in electrical communication with the source of alternating electrical power, the trigger signal generated by the microprocessor being provided to the trigger signal input of the switching device, the switching device selectively switching between a substantially conductive state and a substantially non-conductive state in response to the trigger signal generated by the microprocessor and provided thereto to facilitate the control of the temperature of at least one of the first heater wire of the first heater circuit and the second heater wire of the second heater circuit.

2. A heater wire safety circuit as defined by claim 1, which further comprises:

a fuse, the fuse being in electrical communication with the source of alternating electrical power and being in electrical communication with the power signal input of the switching device; and a crowbar circuit, the crowbar circuit being in electrical communication with the fuse, the crowbar circuit having a crowbar circuit switching device and a crowbar circuit resistor in electrical communication with the crowbar circuit switching device, the crowbar circuit resistor having a first end and a second end opposite the first end, the crowbar circuit switching device having a trigger signal input, a power signal input and a power signal output, the power signal output of the crowbar circuit switching device being in electrical communication with the first end of the crowbar circuit resistor, the second end of the crowbar circuit resistor being in electrical communication with the source of alternating electrical power, the power signal input of the crowbar circuit switching device being in electrical communication with the fuse, the microprocessor being in electrical communication with the crowbar circuit switching device and generating a crowbar circuit trigger signal, the crowbar circuit trigger signal being provided to the trigger signal input of the crowbar circuit switching device.

3. A heater wire safety circuit as defined by claim 1, which further comprises:

a polymetric positive temperature coefficient (PPTC) device, the PPTC device having a first end which is in electrical communication with the source of alternating electrical power, and a second end which is in electrical communication with the first end of the first conductor portion of the first heater wire of the first heater circuit and the first end of the first conductor portion of the second heater wire of the second heater circuit; and a fuse, the fuse being in electrical communication with the source of alternating electrical power and being in electrical communication with the power signal input of the switching device.

4. A heater wire safety circuit for use with an electric blanket or heating pad, which comprises:

a first heater circuit and a second heater circuit, the first heater circuit including:

1) a first heater wire, the first heater wire having:

a) a first conductor portion;

b) a second conductor portion disposed in proximity to the first conductor portion over at least a portion of the length thereof, the first conductor portion having a first end and a second end situated opposite the first end thereof, the second conductor portion having a first end and a second end situated opposite the first end thereof;

c) a low melt insulate layer situated between the first conductor portion and the second conductor portion along at least a portion of the length of the first conductor portion, the first end of the first conductor portion being in electrical communication with a source of alternating electrical power; and d) a first diode, the first diode having an anode and a cathode, the cathode of the first diode being connected to the second end of the first conductor portion of the first heater wire, the anode of the first diode being connected to the first end of the second conductor portion of the first heater wire;

2) a first temperature sensor conductor, the first temperature sensor conductor being disposed in proximity to one of the first conductor portion and the second conductor portion of the first heater wire, the first temperature sensor conductor having a resistance which varies in response to the temperature of at least one of the first conductor portion and the second conductor portion of the first heater wire, the first temperature sensor conductor having a first end and a second end situated opposite the first end thereof; and 3) a second diode, the second diode having an anode and a cathode, the cathode of the second diode being in electrical communication with the source of electrical power and the first end of the first conductor portion of the first heater wire, the anode of the second diode being connected to the first end of the first temperature sensor conductor;

wherein the second heater circuit includes:

1) a second heater wire, the second heater wire having:

a) a first conductor portion;

b) a second conductor portion disposed in proximity to the first conductor portion over at least a portion of the length thereof, the first conductor portion having a first end and a second end situated opposite the first end thereof, the second conductor portion having a first end and a second end situated opposite the first end thereof;

c) a low melt insulate layer situated between the first conductor portion and the second conductor portion along at least a portion of the length of the first conductor portion, the first end of the first conductor portion being in electrical communication with the source of alternating electrical power; and d) a third diode, the third diode having an anode and a cathode, the anode of the third diode being connected to the second end of the first conductor portion of the second heater wire, the cathode of the third diode being connected to the first end of the second conductor portion of the second heater wire;

2) a second temperature sensor conductor, the second temperature sensor conductor being disposed in proximity to one of the first conductor portion and the second conductor portion of the second heater wire, the second temperature sensor conductor having a resistance which varies in response to the temperature of at least one of the first conductor portion and the second conductor portion of the second heater wire, the second temperature sensor conductor having a first end and a second end situated opposite the first end thereof; and 3) a fourth diode, the fourth diode having an anode and a cathode, the anode of the fourth diode being in electrical communication with the source of electrical power and the first end of the first conductor portion of the second heater wire, the cathode of the fourth diode being connected to the first end of the second temperature sensor conductor;

and wherein the heater wire safety circuit further comprises:

a resistor, the resistor having a first end and a second end, the first end of the resistor being in electrical communication with the second end of the first temperature sensor conductor of the first heater circuit and being in electrical communication with the second end of the second temperature sensor conductor of the second heater circuit, the resistor defining with the first temperature sensor conductor and the second temperature sensor conductor a voltage divider circuit, the voltage divider circuit generating a signal thereon which varies in magnitude in response to variations in the resistance of at least one of the first temperature sensor conductor and the second temperature sensor conductor;

a microprocessor, the microprocessor having a signal input, the signal input being in electrical communication with the voltage divider circuit and being provided with the magnitude-varying signal generated by the voltage divider circuit, the microprocessor generating a trigger signal in response to the magnitude-varying signal provided on the signal input of the microprocessor; and a switching device, the switching device having a trigger signal input, a power signal input and a power signal output, the power signal output of the switching device being in electrical communication with the second end of the second conductor portion of the first heater wire of the first heater circuit and being in electrical communication with the second end of the second conductor portion of the second heater wire of the second heater circuit, the power signal input of the switching device being in electrical communication with the source of alternating electrical power, the trigger signal generated by the microprocessor being provided to the trigger signal input of the switching device, the switching device selectively switching between a substantially conductive state and a substantially non-conductive state in response to the trigger signal generated by the microprocessor and provided thereto to facilitate the control of the temperature of at least one of the first heater wire of the first heater circuit and the second heater wire of the second heater circuit.

5. A heater wire safety circuit as defined by claim 4, which further comprises:

a fuse, the fuse being in electrical communication with the source of alternating electrical power and being in electrical communication with the power signal input of the switching device; and a crowbar circuit, the crowbar circuit being in electrical communication with the fuse, the crowbar circuit having a crowbar circuit switching device and a crowbar circuit resistor in electrical communication with the crowbar circuit switching device, the crowbar circuit resistor having a first end and a second end opposite the first end, the crowbar circuit switching device having a trigger signal input, a power signal input and a power signal output, the power signal output of the crowbar circuit switching device being in electrical communication with the first end of the crowbar circuit resistor, the second end of the crowbar circuit resistor being in electrical communication with the source of alternating electrical power, the power signal input of the crowbar circuit switching device being in electrical communication with the fuse, the microprocessor being in electrical communication with the crowbar circuit switching device and generating a crowbar circuit trigger signal, the crowbar circuit trigger signal being provided to the trigger signal input of the crowbar circuit switching device.

6. A heater wire safety circuit as defined by claim 4, which further comprises:

a polymetric positive temperature coefficient (PPTC) device, the PPTC device having a first end which is in electrical communication with the source of alternating electrical power, and a second end which is in electrical communication with the first end of the first conductor portion of the first heater wire of the first heater circuit and the first end of the first conductor portion of the second heater wire of the second heater circuit; and a fuse, the fuse being in electrical communication with the source of alternating electrical power and being in electrical communication with the power signal input of the switching device.

7. A heater wire safety circuit for use with an electric blanket or heating pad, which comprises:

a first heater circuit and a second heater circuit, the first heater circuit including:

1) a first heater wire, the first heater wire having:

a) a first conductor portion;

b) a second conductor portion disposed in proximity to the first conductor portion over at least a portion of the length thereof, the first conductor portion having a first end and a second end situated opposite the first end thereof, the second conductor portion having a first end and a second end situated opposite the first end thereof, at least one of the first conductor portion and the second conductor portion of the first heater wire having a resistance which varies with temperature;

c) a low melt insulate layer situated between the first conductor portion and the second conductor portion along at least a portion of the length of the first conductor portion, the first end of the first conductor portion being in electrical communication with a source of alternating electrical power; and d) a first diode, the first diode having an anode and a cathode, the cathode of the first diode being connected to the second end of the first conductor portion of the first heater wire, the anode of the first diode being connected to the first end of the second conductor portion of the first heater wire;

wherein the second heater circuit includes:

1) a second heater wire, the second heater wire having:

a) a first conductor portion;

b) a second conductor portion disposed in proximity to the first conductor portion over at least a portion of the length thereof, the first conductor portion having a first end and a second end situated opposite the first end thereof, the second conductor portion having a first end and a second end situated opposite the first end thereof, at least one of the first conductor portion and the second conductor portion of the second heater wire having a resistance which varies with temperature;

c) a low melt insulate layer situated between the first conductor portion and the second conductor portion along at least a portion of the length of the first conductor portion, the first end of the first conductor portion being in electrical communication with the source of alternating electrical power; and d) a second diode, the second diode having an anode and a cathode, the anode of the second diode being connected to the second end of the first conductor portion of the second heater wire, the cathode of the second diode being connected to the first end of the second conductor portion of the second heater wire;

and wherein the heater wire safety circuit further comprises:

a capacitor, the capacitor having a first end and a second end, the first end of the capacitor being in electrical communication with the second end of the second conductor portion of the first heater wire of the first heater circuit and being in electrical communication with the second end of the second conductor portion of the second heater wire of the second heater circuit, the capacitor defining with the first heater wire and the second heater wire a voltage divider circuit, the voltage divider circuit generating a signal thereon which varies in phase angle in response to variations in the resistance of at least one of the first heater wire and the second heater wire;

a microprocessor, the microprocessor having a signal input, the signal input being in electrical communication with the voltage divider circuit and being provided with the phase-varying signal generated by the voltage divider circuit, the microprocessor generating a trigger signal in response to the phase-varying signal provided on the signal input of the microprocessor; and a switching device, the switching device having a trigger signal input, a power signal input and a power signal output, the power signal output of the switching device being in electrical communication with the second end of the second conductor portion of the first heater wire of the first heater circuit and being in electrical communication with the second end of the second conductor portion of the second heater wire of the second heater circuit, the power signal input of the switching device being in electrical communication with the source of alternating electrical power, the trigger signal generated by the microprocessor being provided to the trigger signal input of the switching device, the switching device selectively switching between a substantially conductive state and a substantially non-conductive state in response to the trigger signal generated by the microprocessor and provided thereto to facilitate the control of the temperature of at least one of the first heater wire of the first heater circuit and the second heater wire of the second heater circuit.

8. A heater wire safety circuit as defined by claim 7, which further comprises:

a fuse, the fuse being in electrical communication with the source of alternating electrical power and being in electrical communication with the power signal input of the switching device; and a crowbar circuit, the crowbar circuit being in electrical communication with the fuse, the crowbar circuit having a crowbar circuit switching device and a crowbar circuit resistor in electrical communication with the crowbar circuit switching device, the crowbar circuit resistor having a first end and a second end opposite the first end, the crowbar circuit switching device having a trigger signal input, a power signal input and a power signal output, the power signal output of the crowbar circuit switching device being in electrical communication with the first end of the crowbar circuit resistor, the second end of the crowbar circuit resistor being in electrical communication with the source of alternating electrical power, the power signal input of the crowbar circuit switching device being in electrical communication with the fuse, the microprocessor being in electrical communication with the crowbar circuit switching device and generating a crowbar circuit trigger signal, the crowbar circuit trigger signal being provided to the trigger signal input of the crowbar circuit switching device.

9. A heater wire safety circuit as defined by claim 7, which further comprises:

a polymetric positive temperature coefficient (PPTC) device, the PPTC device having a first end which is in electrical communication with the source of alternating electrical power, and a second end which is in electrical communication with the first end of the first conductor portion of the first heater wire of the first heater circuit and the first end of the first conductor portion of the second heater wire of the second heater circuit; and a fuse, the fuse being in electrical communication with the source of alternating electrical power and being in electrical communication with the power signal input of the switching device.

10. A heater wire safety circuit for use with an electric blanket or heating pad, which comprises:

a first heater circuit and a second heater circuit, the first heater circuit including:

1) a first heater wire, the first heater wire having:

a) a first conductor portion;

b) a second conductor portion disposed in proximity to the first conductor portion over at least a portion of the length thereof, the first conductor portion having a first end and a second end situated opposite the first end thereof, the second conductor portion having a first end and a second end situated opposite the first end thereof, at least one of the first conductor portion and the second conductor portion of the first heater wire having a resistance which varies with temperature;

c) a low melt insulate layer situated between the first conductor portion and the second conductor portion along at least a portion of the length of the first conductor portion, the first end of the first conductor portion being in electrical communication with a source of alternating electrical power, the second end of the first conductor portion being in electrical communications with a source of alternating electrical power; and d) a first diode, the first diode having an anode and a cathode, the cathode of the first diode being connected to the second end of the first conductor portion of the first heater wire, the anode of the first diode being connected to the first end of the second conductor portion of the first heater wire;

wherein the second heater circuit includes:

1) a second heater wire, the second heater wire having:

a) a first conductor portion;

b) a second conductor portion disposed in proximity to the first conductor portion over at least a portion of the length thereof, the first conductor portion having a first end and a second end situated opposite the first end thereof, the second conductor portion having a first end and a second end situated opposite the first end thereof, at least one of the first conductor portion and the second conductor portion of the second heater wire having a resistance which varies with temperature;

c) a low melt insulate layer situated between the first conductor portion and the second conductor portion along at least a portion of the length of the first conductor portion, the first end of the first conductor portion being in electrical communication with the source of alternating electrical power; and d) a second diode, the second diode having an anode and a cathode, the anode of the second diode being connected to the second end of the first conductor portion of the second heater wire, the cathode of the second diode being connected to the first end of the second conductor portion of the second heater wire;

and wherein the heater wire safety circuit further comprises:

a resistor, the resistor having a first end and a second end, the first end of the resistor being in electrical communication with the second end of the second conductor portion of the first heater wire of the first heater circuit and being in electrical communication with the second end of the second conductor portion of the second heater wire of the second heater circuit, the resistor defining with the first heater wire and the second heater wire a voltage divider circuit, the voltage divider circuit generating a signal thereon which varies in magnitude in response to variations in the resistance of at least one of the first heater wire and the second heater wire;

a microprocessor, the microprocessor having a signal input, the signal input being in electrical communication with the voltage divider circuit and being provided with the magnitude-varying signal generated by the voltage divider circuit, the microprocessor generating a trigger signal in response to the magnitude-varying signal provided on the signal input of the microprocessor; and a switching device, the switching device having a trigger signal input, a power signal input and a power signal output, the power signal output of the switching device being in electrical communication with the second end of the second conductor portion of the first heater wire of the first heater circuit and being in electrical communication with the second end of the second conductor portion of the second heater wire of the second heater circuit, the power signal input of the switching device being in electrical communication with the source of alternating electrical power, the trigger signal generated by the microprocessor being provided to the trigger signal input of the switching device, the switching device selectively switching between a substantially conductive state and a substantially non-conductive state in response to the trigger signal generated by the microprocessor and provided thereto to facilitate the control of the temperature of at least one of the first heater wire of the first heater circuit and the second heater wire of the second heater circuit.

11. A heater wire safety circuit as defined by claim 10, which further comprises:

a fuse, the fuse being in electrical communication with the source of alternating electrical power and being in electrical communication with the power signal input of the switching device; and a crowbar circuit, the crowbar circuit being in electrical communication with the fuse, the crowbar circuit having a crowbar circuit switching device and a crowbar circuit resistor in electrical communication with the crowbar circuit switching device, the crowbar circuit resistor having a first end and a second end opposite the first end, the crowbar circuit switching device having a trigger signal input, a power signal input and a power signal output, the power signal output of the crowbar circuit switching device being in electrical communication with the first end of the crowbar circuit resistor, the second end of the crowbar circuit resistor being in electrical communication with the source of alternating electrical power, the power signal input of the crowbar circuit switching device being in electrical communication with the fuse, the microprocessor being in electrical communication with the crowbar circuit switching device and generating a crowbar circuit trigger signal, the crowbar circuit trigger signal being provided to the trigger signal input of the crowbar circuit switching device.

12. A heater wire safety circuit as defined by claim 10, which further comprises:

a polymetric positive temperature coefficient (PPTC) device, the PPTC device having a first end which is in electrical communication with the source of alternating electrical power, and a second end which is in electrical communication with the first end of the first conductor portion of the first heater wire of the first heater circuit and the first end of the first conductor portion of the second heater wire of the second heater circuit; and a fuse, the fuse being in electrical communication with the source of alternating electrical power and being in electrical communication with the power signal input of the switching device.

* * * * *